US007686421B2

(12) United States Patent
Yasoshima et al.

(10) Patent No.: US 7,686,421 B2
(45) Date of Patent: Mar. 30, 2010

(54) FLUID INJECTION HEAD, METHOD OF MANUFACTURING THE INJECTION HEAD, AND FLUID INJECTION DEVICE

(75) Inventors: Takeshi Yasoshima, Nagano-ken (JP); Masato Shimada, Nagano-ken (JP); Akira Matsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 1149 days.

(21) Appl. No.: 10/520,662

(22) PCT Filed: Jul. 10, 2003

(86) PCT No.: PCT/JP03/08773

§ 371 (c)(1),
(2), (4) Date: Sep. 26, 2005

(87) PCT Pub. No.: WO2004/007206

PCT Pub. Date: Jan. 22, 2004

(65) Prior Publication Data

US 2006/0152548 A1 Jul. 13, 2006

(30) Foreign Application Priority Data

| | | |
|---|---|---|
| Jul. 10, 2002 | (JP) | 2002-201296 |
| Aug. 2, 2002 | (JP) | 2002-226172 |
| Aug. 5, 2002 | (JP) | 2002-227840 |
| Jan. 7, 2003 | (JP) | 2003-001077 |
| Jul. 8, 2003 | (JP) | 2003-193909 |

(51) Int. Cl.

| | |
|---|---|
| ***B41J 2/135*** | (2006.01) |
| ***B41J 2/045*** | (2006.01) |
| ***G01D 15/00*** | (2006.01) |
| ***G11B 5/127*** | (2006.01) |

(52) U.S. Cl. ..... 347/45; 347/71; 216/27

(58) Field of Classification Search ..... 347/71; 216/27

See application file for complete search history.

(56) References Cited

U.S. PATENT DOCUMENTS 7,381,341 B2 * 6/2008 Shimada et al. ..... 216/27

(Continued)

FOREIGN PATENT DOCUMENTS

EP 0750990 A2 1/1997

(Continued)

OTHER PUBLICATIONS

Article: Silicon Dioxide-Wikipedia, pp. 1-2. Article: Silicon Dioxide-www.ece.gatech.edu/research/labs/vc/theory/oxide.html, p. 1.*

*Primary Examiner*—Matthew Luu
*Assistant Examiner*—Lisa M Solomon
(74) *Attorney, Agent, or Firm*—Sughrue Mion, PLLC

(57) ABSTRACT

Provided is a liquid jet head, a method of manufacturing the same, and a liquid jet apparatus, in which liquid ejecting characteristics can be kept constant for a long period and in which nozzle blockage is prevented. In a liquid jet head including a passage-forming substrate (10) which is made of a single crystal silicon substrate and in which pressure generating chambers (12) communicating with nozzle orifices are formed, and pressure generating elements (300) for causing pressure changes in the pressure generating chambers (12), a protective film (100) which is made of tantalum oxide and has resistance to liquid, is provided at least on the inner wall surfaces of the pressure generating chambers (12).

9 Claims, 14 Drawing Sheets

U.S. PATENT DOCUMENTS

| | | | | |
|---|---|---|---|---|
| 2002/0004150 | A1 * | 1/2002 | Yamada et al. | 428/694 TF |
| 2002/0012029 | A1 | 1/2002 | Miyata | |
| 2002/0041296 | A1 * | 4/2002 | Nagatomo et al. | 347/9 |
| 2002/0140782 | A1 * | 10/2002 | Yasukawa et al. | 347/70 |

FOREIGN PATENT DOCUMENTS

| | | | | |
|---|---|---|---|---|
| JP | 60 054859 | A | | 3/1985 |
| JP | 03-79350 | A | | 4/1991 |
| JP | 05-155023 | A | | 6/1993 |
| JP | 5-286131 | A | | 11/1993 |
| JP | 10-157124 | A | | 6/1998 |
| JP | 10-264383 | A | | 10/1998 |
| JP | 10264383 | A | * | 10/1998 |
| JP | 11-170528 | A | | 6/1999 |
| JP | 11-170553 | A | | 6/1999 |
| JP | 2002-86738 | A | | 3/2002 |
| JP | 2002-172776 | A | | 6/2002 |
| JP | 2002160366 | A | * | 6/2002 |

* cited by examiner (a)

(b)

(a)

(b)

(a)

(b)

(a)

(b)

(a)

(b)

(a)

(b)

(a)

(b)

FLUID INJECTION HEAD, METHOD OF MANUFACTURING THE INJECTION HEAD, AND FLUID INJECTION DEVICE

TECHNICAL FIELD

The present invention relates to a liquid jet head which ejects liquid to be jetted, a method of manufacturing the same, and a liquid jet apparatus. In particular, the present invention relates to an ink-jet recording head, a method of manufacturing the same, and an ink-jet recording apparatus, in which ink droplets are ejected from nozzle orifices by applying pressure, with piezoelectric elements, to ink supplied in pressure generating chambers communicating with the nozzle orifices for ejecting ink droplets.

BACKGROUND ART

Liquid jet apparatuses include, for example, an ink-jet recording apparatus equipped with an ink-jet recording head including a plurality of pressure generating chambers which generate pressure for ejecting ink droplets using piezoelectric elements or heater elements, a common reservoir which supplies the pressure generating chambers with ink, and nozzle orifices communicating with the respective pressure generating chambers. In the ink-jet recording apparatus, ejecting energy is applied to ink in the pressure generating chambers communicating with nozzles corresponding to print signals, thus ejecting ink droplets from the nozzle orifices.

Such ink-jet recording heads are broadly classified into two types regarding the pressure generating chambers, as described above: one in which heater elements such as resistance wires for generating Joule heat in accordance with drive signals are provided in pressure generating chambers, and ink droplets are ejected from nozzle orifices by bubbles generated by the heater elements; and one of a piezoelectric vibration type in which part of pressure generating chambers are constituted of a vibration plate, and ink droplets are ejected from nozzle orifices by deforming the vibration plate by using piezoelectric elements.

Moreover, for the ink-jet recording head of the piezoelectric vibration type, two types are put to practical use: one which uses a piezoelectric actuator of a longitudinal vibration mode that extends and contracts in the axial direction of the piezoelectric elements; and one which uses a piezoelectric actuator of a flexure vibration mode.

In the former, the capacities of the pressure generating chambers can be changed by bringing end faces of the piezoelectric elements into contact with the vibration plate, and therefore a head suitable for high-density printing can be fabricated. However, there is a problem that a manufacturing process is complex as follows: this type requires a difficult process of cutting a piezoelectric element into a comb-teeth shape while allowing the piezoelectric element to coincide with the array pitch of the nozzle orifices, and work of positioning and fixing the cut piezoelectric elements to the pressure generating chambers.

On the other hand, in the latter, the piezoelectric elements can be made and fixed to the vibration plate by a relatively easy process in which a green sheet of piezoelectric material is attached to the vibration plate in accordance with the shapes of the pressure generating chambers and then baked. However, because of the utilization of flexure vibration, a certain area is required, and therefore there is a problem that high-density arrangement is difficult.

Meanwhile, in order to eliminate the disadvantage of the latter recording head, for example, as disclosed in Japanese Unexamined Patent Publication No. Hei 5(1993)-286131, a recording head has been proposed, in which a uniform piezoelectric material layer is formed over the entire surface of a vibration plate by deposition technology, and the piezoelectric material layer is cut into shapes corresponding to pressure generating chambers by lithography, thus forming piezoelectric elements independently for the respective pressure generating chambers.

This eliminates work of attaching the piezoelectric elements to the vibration plate, and the piezoelectric elements can be made and fixed thereto at high density by a precise and simple method, namely, lithography. In addition, there is an advantage that the thickness of the piezoelectric elements can be reduced and therefore high-speed drive becomes possible.

In general, in such a conventional ink-jet recording head, ink cavities (pressure generating chambers) are formed in a silicon substrate, and a vibration plate constituting one surfaces of the ink cavities is formed of a silicon oxide film. Accordingly, if alkaline ink is used, the silicon substrate is gradually dissolved by the ink, and the width of each pressure generating chamber changes with a lapse of time. This causes changes in pressure to be given to the pressure generating chambers by the drive of piezoelectric elements, and therefore there is a problem that ink ejecting characteristics are gradually deteriorated. In order to solve such a problem, for example, as disclosed in Japanese Unexamined Patent Publication No. Hei 10(1998)-264383, there is a recording head in which a silicon substrate and the like are prevented from being dissolved by ink by providing a hydrophilic and alkaline-resistant film, e.g., a nickel film or the like, in ink cavities.

As described above, it is possible to prevent the dissolution caused by ink to a certain degree by providing the nickel film or the like in the ink cavities. However, since the nickel film or the like is also gradually dissolved by ink, there is a problem that ink ejecting characteristics are degraded after a long period of use. In particular, when ink at a relatively high pH is used, the rate of solution is increased, and therefore ink ejecting characteristics are also degraded within a relatively short period.

Moreover, for example, as disclosed in Japanese Unexamined Patent Publication No. 2002-160366, there is a structure in which the destruction of piezoelectric elements due to an external environment is prevented by joining a sealing plate having a piezoelectric element holding portion for sealing the piezoelectric elements onto one surface, on a piezoelectric element side, of a passage-forming substrate in which pressure generating chambers are formed. In such a sealing plate, a reservoir portion constituting part of an ink chamber common to the pressure generating chambers is provided, but in reality the resistance to ink in the reservoir portion is not taken into consideration. In other words, the reservoir portion is a portion where ink to be supplied to the pressure generating chambers is held in reserve and hardly becomes a direct factor in the degradation of ink ejecting characteristics. Therefore, in a conventional ink-jet recording head, the resistance to ink in the reservoir portion has not been taken into consideration.

However, for example, if alkaline ink is used in the case where a single crystal silicon (Si) substrate is used as a material for a sealing plate, the inner wall surface of a reservoir portion are gradually dissolved by the ink similarly to the case of pressure generating chambers. When the shape of the reservoir portion is greatly changed accordingly, a defect in the supply of ink to pressure generating chambers is caused and may lead to the degradation of ink ejecting characteristics.

Further, there may be cases where dissolved materials of the sealing plate generated from the inner wall surface of the reservoir portion dissolved in ink become deposits (Si) separated in the ink along with, for example, a temperature change or the like. The deposits are carried with the ink to the pressure generating chambers, and so-called nozzle blockage may be also caused.

Note that the above-described problems exist not only in an ink-jet recording head for ejecting ink but also similarly exist in other liquid jet head for jetting alkaline liquid other than ink, as a matter of course.

DISCLOSURE OF THE INVENTION

In light of the above-described circumstances, an object of the present invention is to provide a liquid jet head, a method of manufacturing the same, and a liquid jet apparatus, in which liquid ejecting characteristics can be kept constant for a long period and in which nozzle blockage is prevented.

A first aspect of the present invention for accomplishing the above object is a liquid jet-head including a passage-forming substrate which is made of a single crystal silicon substrate and in which pressure generating chambers communicating with nozzle orifices are formed; and pressure generating elements for causing pressure changes in the pressure generating chambers. In the liquid jet head, a protective film which is made of tantalum oxide and has resistance to liquid, is provided at least on inner wall surfaces of the pressure generating chambers.

In the first aspect, a protective film having excellent resistance to etching by liquid can be formed, and the passage-forming substrate can be certainly prevented from being dissolved in the liquid. Accordingly, the shape of each pressure generating chamber can be maintained almost the same as when manufactured, and liquid ejecting characteristics can be kept constant for a long period. Moreover, nozzle blockage can also be prevented.

A second aspect of the present invention is the liquid jet head according to the first aspect, wherein an etching rate of the protective film in a liquid at pH 8.0 or more is 0.05 nm/day or less.

In the second aspect, since the protective film has excellent resistance to etching by alkaline liquid, the shape of each pressure generating chamber can be maintained almost the same as when manufactured for a longer period.

A third aspect of the present invention is the liquid jet head according to any one of the first and second aspects, wherein the protective film is formed by ion assisted deposition.

In the third aspect, a dense protective film can be relatively easily and assuredly formed.

A fourth aspect of the present invention is the liquid jet head according to any one of the first and second aspects, wherein the protective film is formed by facing-target sputtering.

In the fourth aspect, a dense protective film can be relatively easily and assuredly formed.

A fifth aspect of the present invention is the liquid jet head according to any one of the first and second aspects, wherein the protective film is formed by plasma CVD.

In the fifth aspect, a dense protective film can be relatively easily and assuredly formed.

A sixth aspect of the present invention is the liquid jet head according to any one of the first to fifth aspects, wherein liquid passages for supplying liquid to the pressure generating chambers are provided in the passage-forming substrate, and the protective film is also provided on inner wall surfaces of the liquid passages.

In the sixth aspect, since the protective film certainly prevents the inner wall surfaces of the liquid passages from being dissolved by the liquid, the shapes of the liquid passages can be maintained almost the same as when manufactured. Accordingly, the liquid can be favorably supplied to each pressure generating chamber.

A seventh aspect of the present invention is the liquid jet head according to any one of the first to sixth aspects, wherein the pressure generating elements are piezoelectric elements arranged on a vibration plate provided on one side of each pressure generating chamber.

In the seventh aspect, the piezoelectric elements are flexibly displaced to cause pressure changes in the pressure generating chambers through the vibration plate, thus ejecting liquid droplets from the nozzle orifices.

An eighth aspect of the present invention is the liquid jet head according to the seventh aspect, wherein the pressure generating chambers are formed in the single crystal silicon substrate by anisotropic etching, and each layer of the piezoelectric elements is formed by deposition and lithography.

In the eighth aspect, liquid jet heads having high-density nozzle orifices can be relatively easily manufactured in large quantities.

A ninth aspect of the present invention is the liquid jet head according to any one of the seventh and eighth aspects, the liquid jet head further including a sealing plate made of a single crystal silicon substrate. The sealing plate has a piezoelectric element holding portion for sealing a space enough not to inhibit the movement of the piezoelectric elements in a state where the space is ensured. In this liquid jet head, the sealing plate has a reservoir portion constituting at least part of a common liquid chamber common to the pressure generating chambers, and the protective film is provided at least on an inner wall surface of the reservoir portion.

In the ninth aspect, the inner wall surface of the reservoir portion, i.e., the sealing plate can be prevented from being dissolved in liquid. Accordingly, the liquid is favorably supplied to the pressure generating chambers to more favorably maintain liquid ejecting characteristics, and the occurrence of nozzle blockage is more certainly prevented.

A tenth aspect of the present invention is a liquid jet head including a passage-forming substrate in which pressure generating chambers communicating with nozzle orifices are formed; piezoelectric elements which are provided on one side of the passage-forming substrate with a vibration plate interposed therebetween and cause pressure changes in the pressure generating chambers; and a sealing plate which is made of a single crystal silicon substrate and has a piezoelectric element holding portion for sealing a space sufficient enough so as not to inhibit the movement of the piezoelectric elements in a state where the space is ensured. In this liquid jet head, the sealing plate has a reservoir portion constituting at least part of a common liquid chamber common to the pressure generating chambers, and a protective film having resistance to liquid is provided at least on an inner wall surface of the reservoir portion.

In the tenth aspect, the protective film prevents the sealing plate from being dissolved by liquid, and the shape of the reservoir portion is maintained almost the same as when manufactured for a long period. Thus, the shape of the reservoir portion is substantially stabilized, and therefore the liquid can be favorably supplied to each pressure generating chamber. Moreover, since the amount of dissolved materials, generated in such a manner that the sealing plate is dissolved by the liquid, is remarkably reduced, the occurrence of nozzle blockage is prevented.

An eleventh aspect of the present invention is the liquid jet head according to the tenth aspect, wherein the protective film is provided on an entire surface of the sealing plate including the inner wall surface of the reservoir portion.

In the eleventh aspect, work of manufacturing the sealing plate can be simplified by providing the protective film on the entire surface of the sealing plate.

A twelfth aspect of the present invention is the liquid jet head according to any one of the tenth and eleventh aspects, wherein the protective film is a silicon dioxide film formed by thermally oxidizing the sealing plate.

In the twelfth aspect, a protective film which has an almost uniform thickness and in which no pinholes are generated can be relatively easily and certainly formed.

A thirteenth aspect of the present invention is the liquid jet head according to the tenth aspect, wherein the protective film is made of dielectric material and formed by physical vapor deposition (PVD).

In the thirteenth aspect, since the protective film prevents the dissolution (erosion) of the sealing plate caused by a predetermined liquid, e.g., ink or the like, the shape of the reservoir portion is maintained almost the same as when manufactured for a long period. Moreover, since dissolved materials of the sealing plate dissolved in the liquid can be prevented from being separated in the liquid, the occurrence of nozzle blockage is prevented. Furthermore, the protective film can be easily formed by physical vapor deposition (PVD).

A fourteenth aspect of the present invention is the liquid jet head according to the thirteenth aspect, wherein the protective film is formed by any one of reactive ECR sputtering, facing-target sputtering, ion beam sputtering, and ion assisted deposition.

In the fourteenth aspect, by use of a predetermined method, the protective film can be formed at relatively low temperature, and the other regions of the sealing plate can be prevented from being adversely affected when the protective film is formed.

A fifteenth aspect of the present invention is the liquid jet head according to any one of the thirteenth and fourteenth aspects, wherein the protective film is made of any one of tantalum oxide, silicon nitride, aluminum oxide, zirconium oxide, and titanium oxide.

In the fifteenth aspect, a protective film having very excellent erosion resistance to a predetermined liquid, such as ink, can be formed by use of a specific material for the protective film.

A sixteenth aspect of the present invention is the liquid jet head according to any one of the thirteenth to fifteenth aspects, wherein the protective film is formed on a joint surface of the sealing plate with the passage-forming substrate as well as on the inner wall surface of the of the reservoir portion.

In the sixteenth aspect, by forming the protective film from the joint surface side of the sealing plate with the passage-forming substrate, the protective film is formed also on the joint surface, but the protective film is not formed on the surface of the sealing plate.

A seventeenth aspect of the present invention is the liquid jet head according to the sixteenth aspect, wherein interconnections for connecting the piezoelectric elements and a drive IC for driving the piezoelectric elements are provided on a surface of the sealing plate on the opposite side to the piezoelectric element holding portion.

In the seventeenth aspect, since the protective film is not formed on the surface of the sealing plate on the opposite side to the passage-forming substrate, the interconnections can be favorably formed on the sealing plate, and the drive IC can be mounted on the sealing plate with the interconnections interposed therebetween.

An eighteenth aspect of the present invention is the liquid jet head according to any one of the tenth to seventeenth aspects, wherein the protective film is provided also on inner wall surfaces of the pressure generating chambers.

In the eighteenth aspect, the inner wall surface of the reservoir portion, i.e., the sealing plate can be certainly prevented from being dissolved in liquid. Accordingly, the liquid can be favorably supplied to the pressure generating chambers, and the occurrence of nozzle blockage can be more certainly prevented.

A nineteenth aspect of the present invention is a liquid jet apparatus including the liquid jet head according to any one of the first to eighteenth aspects.

In the nineteenth aspect, a liquid jet apparatus in which liquid ejecting characteristics are substantially stabilized and reliability is improved, can be realized.

A twentieth aspect of the present invention is a method of manufacturing a liquid jet head including a passage-forming substrate which is made of a single crystal silicon substrate and in which pressure generating chambers communicating with nozzle orifices are formed, and piezoelectric elements which are provided on one side of the passage-forming substrate with a vibration plate interposed therebetween and cause pressure changes in the pressure generating chambers. The method includes the step of forming a protective film which is made of metal material and has resistance to liquid, at least on inner wall surfaces of the pressure generating chambers under a temperature condition of 150° C. or lower.

In the twentieth aspect, the protective film can be formed under relatively low temperature conditions, e.g., at 150° C. or lower. Accordingly, for example, it is possible to certainly prevent the piezoelectric elements and the like from being damaged.

A twenty-first aspect of the present invention is the method according to the twentieth aspect, wherein the protective film is formed by ion assisted deposition.

In the twenty-first aspect, the protective film can be formed under relatively low temperature conditions.

A twenty-second aspect of the present invention is the method according to the twentieth aspect, wherein the protective film is formed by facing-target sputtering.

In the twenty-second aspect, a dense film is formed to an almost uniform thickness on the inner surfaces of the pressure generating chambers and the like. Moreover, since the deposition rate is high, the manufacturing efficiency is improved.

A twenty-third aspect of the present invention is the method according to the twenty-second aspect, wherein when the protective film is formed, the passage-forming substrate is placed so that a longitudinal direction of the pressure generating chambers is perpendicular to a direction of surfaces of facing targets.

In the twenty-third aspect, the protective film can be relatively easily and favorably formed on the entire inner surfaces of the pressure generating chambers and the like.

A twenty-fourth aspect of the present invention is the method according to the twentieth aspect, wherein the protective film is formed by plasma CVD.

In the twenty-fourth aspect, a continuous protective film over the entire inner surfaces of the pressure generating chambers and the like can be relatively easily and favorably formed.

A twenty-fifth aspect of the present invention is the method according to any one of the twentieth to twenty-fourth aspects, wherein the metal material is any one of tantalum oxide and zirconium oxide.

In the twenty-fifth aspect, film formation is possible under relatively low temperature conditions, and a protective film having excellent resistance to etching by liquid can be formed. In particular, a protective film made of tantalum oxide exerts especially excellent resistance to etching by a liquid at a relatively high pH, e.g., at pH 8.0 or more. Thus, the shape of each pressure generating chamber can be maintained almost the same as when the product was manufactured for a long period.

A twenty-sixth aspect of the present invention is the method according to any one of the twentieth to twenty-fifth aspects, wherein after liquid passages for supplying liquid to the pressure generating chambers are formed in the passage-forming substrate, the protective film is also formed on inner wall surfaces of the liquid passages.

In the twenty-sixth aspect, since the protective film can certainly prevent the inner wall surfaces of the liquid passages from being dissolved in the liquid, the shapes of the liquid passages can be maintained almost the same as when the product was manufactured. Accordingly, the liquid can be favorably supplied to each pressure generating chamber.

A twenty-seventh aspect of the present invention is a method of manufacturing a liquid jet head including a passage-forming substrate in which pressure generating chambers communicating with nozzle orifices for jetting liquid are formed; piezoelectric elements which are provided on one side of the passage-forming substrate with a vibration plate interposed therebetween and cause pressure changes in the pressure generating chambers; and a sealing plate which is made of a single crystal silicon substrate and has a piezoelectric element holding portion for sealing a space enough not to inhibit the movement of the piezoelectric elements in a state where the space is ensured. Here, the sealing plate further has a reservoir portion constituting at least part of a reservoir communicating with the pressure generating chambers. The method includes the steps of: forming a mask pattern on a surface of a sealing plate forming material, which becomes the sealing plate; forming the reservoir portion and the piezoelectric element holding portion by etching the sealing plate forming material except a region where the mask pattern has been formed; removing the mask pattern to form the sealing plate; forming a protective film having resistance to liquid at least on an inner wall surface of the reservoir portion in the sealing plate; and joining the passage-forming substrate in which the piezoelectric elements have been formed and the sealing plate.

In the twenty-seventh aspect, since the protective film prevents the sealing plate from being dissolved by the liquid, the shape of the reservoir portion can be maintained almost the same as when manufactured for a long period. That is, since the shape of the reservoir portion is substantially stabilized, the liquid can be favorably supplied to each pressure generating chamber. Moreover, since the amount of dissolved materials of the sealing plate dissolved in the liquid, is remarkably reduced, the occurrence of nozzle blockage is prevented.

A twenty-eighth aspect of the present invention is the method according to the twenty-seventh aspect, wherein the protective film is formed on an entire surface of the sealing plate including the inner wall surface of the reservoir portion.

In the twenty-eighth aspect, work of manufacturing the sealing plate can be simplified by providing the protective film on the entire surface of the sealing plate.

A twenty-ninth aspect of the present invention is the method according to any one of the twenty-seventh and twenty-eighth aspects, wherein the protective film made of silicon dioxide is formed by thermally oxidizing the sealing plate.

In the twenty-ninth aspect, a protective film which has an almost uniform thickness and in which no pinholes are generated, can be relatively easily and reliably formed.

A thirtieth aspect of the present invention is the method according to any one of the twenty-seventh to twenty-ninth aspects, the method further including the step of forming interconnections for connecting the piezoelectric elements and a drive IC for driving the piezoelectric elements, on the protective film of the sealing plate on the opposite side to the piezoelectric element holding portion, after the step of forming the protective film.

In the thirtieth aspect, since the protective film is formed to an almost uniform thickness with no pin holes generated therein, the interconnections and the sealing plate are certainly insulated.

A thirty-first aspect of the present invention is the method according to the twenty-seventh aspect, wherein the protective film made of dielectric material is formed by physical vapor deposition (PVD).

In the thirty-first aspect, the protective film can be easily and favorably formed on the inner surface of the reservoir portion, and other regions are not adversely affected.

A thirty-second aspect of the present invention is the method according to the thirty-first aspect, wherein the protective film is formed by any one of reactive ECR sputtering, facing-target sputtering, ion beam sputtering, and ion assisted deposition.

In the thirty-second aspect, by use of a predetermined method, the protective film can be formed at relatively low temperature, and the other regions of the sealing plate are not adversely affected when the protective film is formed.

A thirty-third aspect of the present invention is the method according to any one of the thirty-first and thirty-second aspects, wherein the protective film is made of any one of tantalum oxide, silicon nitride, aluminum oxide, zirconium oxide, and titanium oxide.

In the thirty-third aspect, a protective film having excellent erosion resistance to a predetermined liquid, such as ink, can be formed by use of a specific material for the protective film.

A thirty-fourth aspect of the present invention is the method according to any one of the thirty-first to thirty-third aspects, wherein the piezoelectric element holding portion and the reservoir portion are formed by etching the sealing plate forming material by using an insulation film, which has been formed by thermally oxidizing the sealing plate forming material, as the mask pattern.

In the thirty-fourth aspect, the piezoelectric element holding portion and the reservoir portion can be relatively easily and very precisely formed in the sealing plate forming material.

A thirty-fifth aspect of the present invention is the method according to the thirty-fourth aspect, the method further including the step of forming interconnections for connecting the piezoelectric elements and a drive IC for driving the piezoelectric elements, on the insulation film, before the step of forming the piezoelectric element holding portion and the reservoir portion.

In the thirty-fifth aspect, since the interconnections and the sealing plate are certainly insulated with the insulation film, the drive IC can be favorably mounted on the sealing plate with the interconnections interposed therebetween.

BEST MODES FOR CARRYING OUT THE INVENTION

The present invention will be described in detail below based on embodiments.

Embodiment 1

Figure 1:
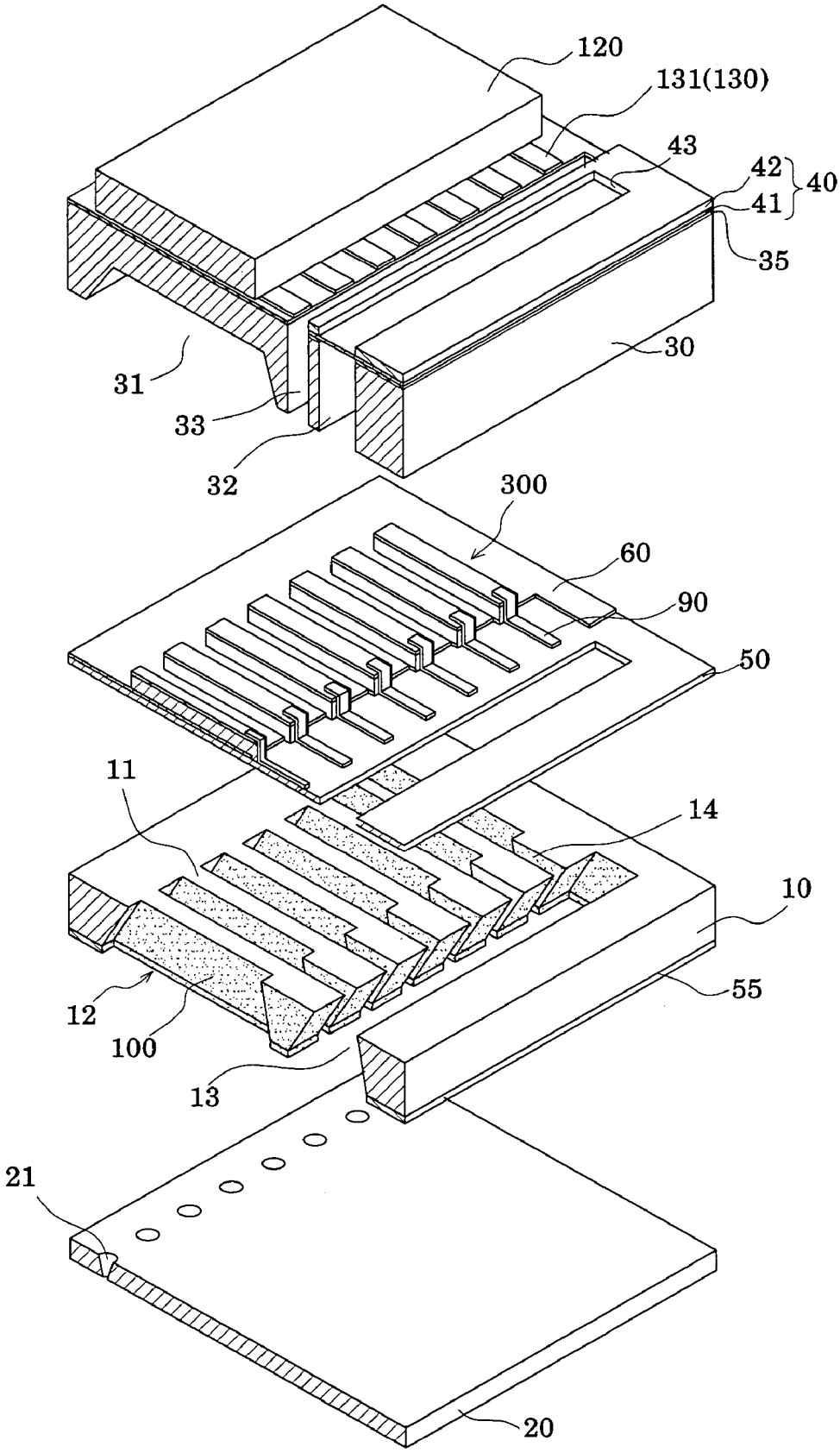
FIG. 1 is an exploded perspective view of a recording head according to Embodiment 1.
Figure 2:
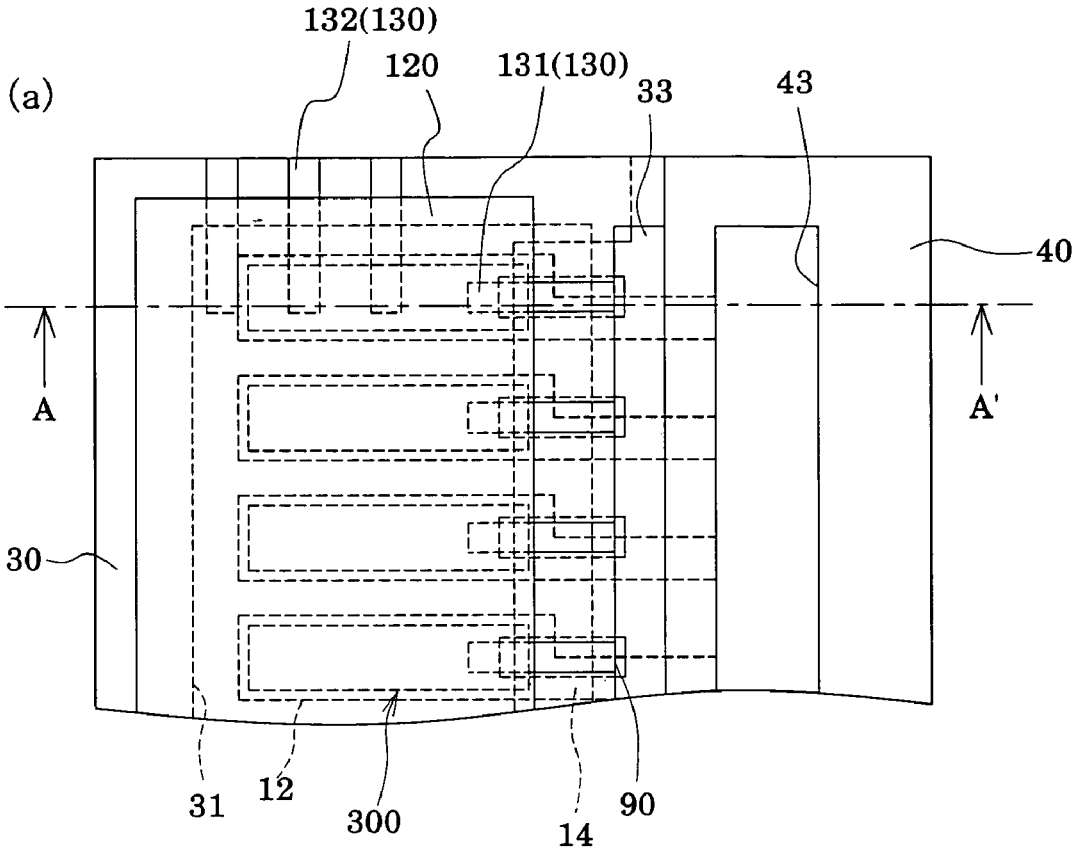
FIGS. 2(*a*) and 2(*b*) are a plan view and a sectional view of the recording head according to Embodiment 1, respectively.
Figure 2:
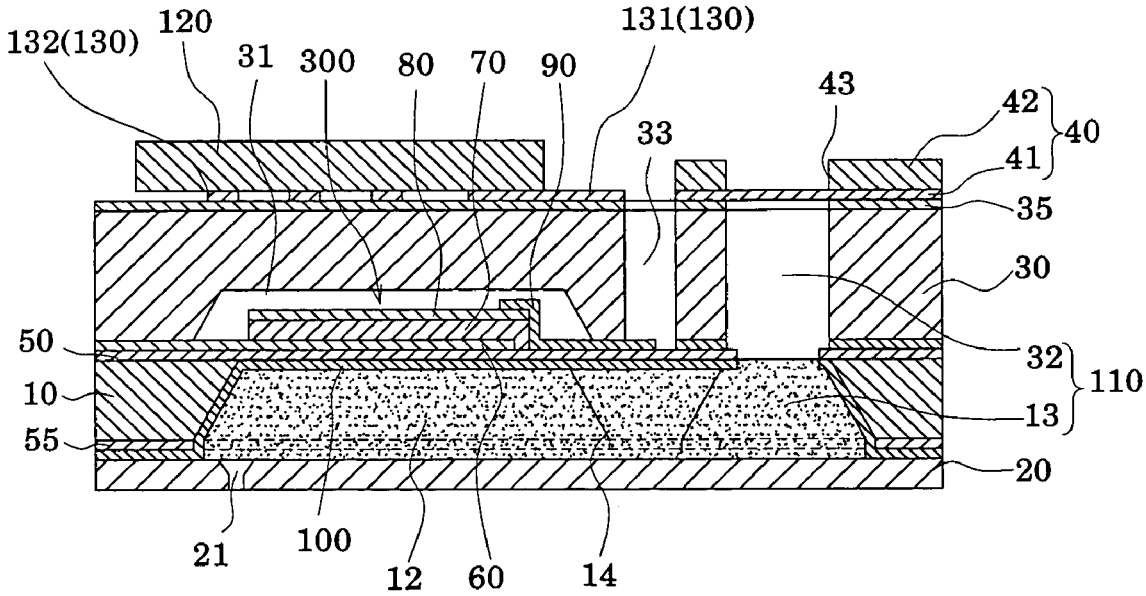

FIG. 1 is an exploded perspective view outlining an ink-jet recording head according to Embodiment 1 of the present invention. FIGS. 2(*a*) and 2(*b*) are a plan view and a sectional view of FIG. 1, respectively. As shown in these drawings, a passage-forming substrate 10 is made of a single crystal silicon substrate of plane orientation (110) in the present embodiment. An elastic film 50 and an insulation film 55, each having a thickness of 1 to 2 μm and made of silicon dioxide formed by thermal oxidation, are formed in advance on respective surfaces of the passage-forming substrate 10. In the passage-forming substrate 10, pressure generating chambers 12 which are divided into sections by a plurality of compartment walls 11 are arranged in parallel in the width direction thereof by performing anisotropic etching from one side of the passage-forming substrate 10. Moreover, on the outside of the pressure generating chambers 12 in the longitudinal direction thereof, a communicating portion 13 made to communicate with an undermentioned reservoir portion of a sealing plate is formed. Further, the communicating portion 13 is made to communicate with one of the ends of each of the pressure generating chambers 12 in the longitudinal direction through respective ink supply paths 14.

Here, the anisotropic etching is performed utilizing a difference between etching rates of the single crystal silicon substrate. For example, in the present embodiment, when the single crystal silicon substrate is dipped in an alkaline solution such as KOH, the single crystal silicon substrate is gradually eroded. Consequently, there appear a first (111) plane, which is perpendicular to a (110) plane, and a second (111) plane, which is at approximately a 70-degree angle to the first (111) plane and at approximately a 35-degree angle to the (110) plane. The anisotropic etching is performed by utilizing a characteristic that the etching rate of the (111) planes is approximately 1/180 of that of the (110) plane. This anisotropic etching enables high-precision processing based on the depth processing of a parallelogram formed by two first (111) planes and two slanted second (111) planes. Thus, the pressure generating chambers 12 can be arranged in high density. In the present embodiment, the long sides and short sides of each pressure generating chamber 12 are formed by the first (111) planes and the second (111) planes, respectively. These pressure generating chambers 12 are formed by etching the passage-forming substrate 10 so as to almost penetrate the passage-forming substrate 10 until reaching the elastic film 50. Here, the amount of the elastic film 50 eroded by the alkaline solution used for etching the single crystal silicon substrate, is extremely small. In addition, each ink supply path 14, communicating with one end of each respective pressure generating chamber 12, is formed to be narrower than the pressure generating chamber 12 in the width direction. Thus, the passage resistance of ink which flows into the pressure generating chambers 12 is kept constant.

An optimal thickness of the passage-forming substrate 10, where the pressure generating chambers 12 and the like are formed as described above, is preferably selected in accordance with the density at which the pressure generating chambers 12 are arranged. For example, when approximately 180 pressure generating chambers 12 are arranged per inch (180 dpi), the thickness of the passage-forming substrate 10 is preferably set to approximately 180 to 280 μm, more preferably approximately 220 μm. Further, for example, when the pressure generating chambers 12 are arranged at a relatively high density of approximately 360 dpi, it is preferable that the thickness of the passage-forming substrate 10 be 100 μm or less. This is because the arrangement density can be increased while maintaining the rigidity of the compartment walls 11 between the adjacent pressure generating chambers 12.

A nozzle plate 20 provided with nozzle orifices 21 which communicate with the opposite ends of the pressure generating chambers 12 to the ink supply paths 14, is fixed to an opening surface side of the passage-forming substrate 10 through an adhesive agent, a thermowelding film or the like, thus sealing the pressure generating chambers 12 and the like. Note that the nozzle plate 20 is made of stainless steel (SUS) in the present embodiment.

Here, a protective film 100, which is made of tantalum oxide and has resistance to ink, is provided at least on the inner wall surfaces of the pressure generating chambers 12 in the passage-forming substrate 10. For example, in the present embodiment, the protective film 100 made of tantalum pentoxide ($Ta_2O_5$) is provided on all the surfaces to be brought into contact with ink, of the passage-forming substrate 10. Specifically, the protective film 100 is provided on the surfaces of the compartment walls 11 and of the elastic film 50 in the pressure generating chambers 12, and further provided on the inner wall surfaces of ink passages of the communicating portion 13 and the ink supply paths 14 which communicate with the pressure generating chambers 12. The thickness of such a protective film 100 is not particularly limited, but in the present embodiment, it is set to approximately 50 nm in consideration of the size of each pressure generating chamber 12, a displacement amount of a vibration plate, and the like.

Such a protective film 100 made of tantalum oxide has very excellent resistance to etching by ink (resistance to ink), particularly resistance to etching by alkaline ink. Specifically, it is preferable that the etching rate in an ink at pH 8.0 or more be 0.05 nm/day or less at 25° C. As described above, the protective film 100 made of tantalum oxide has very excellent resistance to etching by ink with relatively high alkalinity. Accordingly, the protective film 100 made of tantalum oxide is particularly effective against ink for an ink-jet recording head. For example, the protective film 100 made of tantalum pentoxide in the present embodiment has an etching rate of 0.03 nm/day in an ink at pH 9.1 at 25° C.

Since the protective film 100 made of tantalum pentoxide is provided at least on the inner wall surfaces of the pressure generating chambers 12 as described above, the passage-forming substrate 10 and the vibration plate can be prevented from being dissolved in ink. This makes it possible to substantially stabilize the shapes of the pressure generating chambers 12, that is, to maintain the shapes of the pressure generating chambers 12 almost the same as when manufactured. Moreover, in the present embodiment, the protective film 100 is also provided on the inner wall surfaces of the ink passages of the ink supply paths 14 and the communicating portion 13, in addition to the inner wall surfaces of the pressure generating chambers 12. Accordingly, for a similar reason to that of the pressure generating chambers 12, the shapes of the ink supply paths 14 and of the communicating portion 13 can be also maintained almost the same as when manufactured. These make it possible to keep ink ejecting characteristics constant for a long period by providing the protective film 100. Furthermore, since the passage-forming substrate 10 can be prevented from being dissolved in ink by the protective film 100, the amount of deposits in the ink separated out of dissolved materials of the passage-forming substrate 10 dissolved in the ink, is substantially reduced. This makes it possible to prevent the occurrence of nozzle blockage. Thus, ink droplets can be favorably ejected from the nozzle orifices 21.

Note that, as a material for the protective film 100, for example, zirconium oxide ($ZrO_2$), nickel (Ni), chrome (Cr), or the like can be also used depending on the pH of ink to be used. However, by use of tantalum oxide, excellent resistance to etching is exerted even when an ink at high pH is used.

Moreover, in the present embodiment, the protective film 100 is also formed on the surface of the passage-forming substrate 10 on the side where the pressure generating chambers 12 and the like open, and the passage-forming substrate 10 and the nozzle plate 20 are joined with the protective film 100 interposed therebetween. Accordingly, the effect that adhesive strength therebetween is improved is also achieved. It is needless to say that since ink does not substantially come into contact with the joint surface with the nozzle plate 20, the protective film 100 does not have to be provided on the joint surface.

Furthermore, in the present embodiment, the ink-resistant protective film 100 is provided on the inner wall surfaces of the pressure generating chambers 12, of the communicating portion 13, and of the ink supply paths 14, but not limited to on these. It is sufficient that the protective film 100 be provided at least on the inner wall surfaces of the pressure generating chambers 12. Such a structure also makes it possible to keep ink ejecting characteristics constant for a long period.

Meanwhile, on the elastic film 50 on the opposite side to the opening surface of the above-described passage-forming substrate 10, a lower electrode film 60 with a thickness of, for example, approximately 0.2 μm, piezoelectric layers 70 with a thickness of, for example, approximately 1 μm, and upper electrode films 80 with a thickness of, for example, approximately 0.1 μm are formed in a stacking manner through a process to be described later to constitute piezoelectric elements 300. Here, the piezoelectric element 300 means a portion including the lower electrode film 60, the piezoelectric layer 70, and the upper electrode film 80. In general, any one electrode of the piezoelectric element 300 is used as a common electrode, and the other electrode and the piezoelectric layer 70 are formed by patterning for each pressure generating chamber 12. Here, a portion which includes any one electrode and the piezoelectric layer 70 obtained by patterning and in which piezoelectric strain occurs due to the application of a voltage to both the electrodes, is referred to as a piezoelectric active portion. In the present embodiment, the lower electrode film 60 is used as a common electrode of the piezoelectric element 300, and the upper electrode film 80 is used as an individual electrode of the piezoelectric element 300. However, even if these are reversed on account of a drive circuit and wiring, there is no problem. In any case, the piezoelectric active portion is formed for each pressure generating chamber 12. Moreover, here, the piezoelectric elements 300 and the vibration plate in which displacement occurs by driving the piezoelectric elements 300 are collectively referred to as a piezoelectric actuator. Further, lead electrodes 90 made of, for example, gold (Au), are connected to the respective upper electrode films 80 of the above-described piezoelectric elements 300. The lead electrodes 90 are led from the vicinities of ends in the longitudinal direction of the piezoelectric elements 300 and extended to regions corresponding to the ink supply paths 14, on the elastic film 50.

In a state where a space sufficient enough so as not to inhibit the movement of the piezoelectric elements 300 is ensured, the sealing plate 30 having a piezoelectric element holding portion 31 capable of sealing the space is joined to the piezoelectric element 300 side of the passage-forming substrate 10, and the piezoelectric elements 300 are sealed in the piezoelectric element holding portion 31. Further, the reservoir portion 32 penetrating the sealing plate 30 is provided in the sealing plate 30, in a region facing the communicating portion 13. The reservoir portion 32 is made to communicate with the communicating portion 13 of the passage-forming substrate 10 as described previously to constitute a reservoir 110, which serves as an ink chamber common to the pressure generating chambers 12. The sealing plate 30 as described above is preferably made of a material having almost the same thermal expansion coefficient as that of the passage-forming substrate 10, for example, glass, a ceramic material, or the like. In the present embodiment, the sealing plate 30 was formed using a single crystal silicon substrate, which is made of the same material as that of the passage-forming substrate 10.

Note that a penetrated hole 33 penetrating the sealing plate 30 in the thickness direction thereof is provided between the piezoelectric element holding portion 31 and the reservoir portion 32 of the sealing plate 30, i.e., in a region corresponding to the ink supply paths 14. The vicinities of ends of the lead electrodes 90 led from the respective piezoelectric elements 300 are exposed in the penetrated hole 33.

Further, an insulation film 35 made of silicon dioxide is provided on the surface of the sealing plate 30, i.e., the surface on the opposite side to the joint surface with the passage-forming substrate 10. On the insulation film 35, a drive IC (semiconductor integrated circuit) 120 for driving the piezoelectric elements 300 is mounted. Specifically, interconnections 130 (first interconnections 131, second interconnections 132) for connecting the drive IC 120 with the piezoelectric elements 300 are formed in a predetermined pattern on the sealing plate 30, and the drive IC 120 is mounted on the interconnections 130. For example, in the present embodiment, the drive IC 120 is electrically connected to the interconnections 130 by flip-chip mounting.

Note that the lead electrodes 90 led from the respective piezoelectric elements 300 are connected to the first interconnections 131 using coupling interconnections (not shown) extended into the penetrated hole 33 of the sealing plate 30. Moreover, an external interconnection (not shown) is connected to the second interconnections 132.

To a region facing the reservoir portion 32 of the sealing plate 30 as described above, a compliance plate 40 including a sealing film 41 and a fixing plate 42 is joined. The sealing film 41 is made of a flexible material with low rigidity (e.g., a polyphenylene-sulfide (PPS) film with a thickness of 6 μm). One side of the reservoir portion 32 is sealed with the sealing film 41. The fixing plate 42 is made of a hard material such as metal (e.g., stainless steel (SUS) or the like formed to a thickness of 30 μm). A region of the fixing plate 42 facing the reservoir 110 is an opening portion 43 where the fixing plate 42 is completely removed in the thickness direction thereof. Therefore, one side of the reservoir 110 is sealed with only the sealing film 41 having flexibility.

In the ink-jet recording head of the present embodiment as described above, ink is supplied from external ink supply means (not shown), and the inside from the reservoir 110 to the nozzle orifices 21 is filled with the ink. Thereafter, in accordance with record signals from a drive circuit (not shown), voltages are applied between the lower and upper electrode films 60 and 80 corresponding to the respective pressure generating chambers 12 through the external interconnection, thereby flexibly deforming the elastic film 50, the lower electrode film 60, and the piezoelectric layers 70. Thus, pressure in each pressure generating chamber 12 is increased, and ink droplets are ejected from the nozzle orifices 21.

Hereinafter, a method of manufacturing the ink-jet recording head of the present embodiment as described above, particularly a process of forming the piezoelectric elements 300 on the passage-forming substrate 10 and a process of forming the pressure generating chambers 12 and the like in the passage-forming substrate 10, will be described with reference to FIGS. 3(*a*) to 5(*b*). Incidentally, FIGS. 3(*a*) to 5(*b*) are sectional views of the pressure generating chamber 12 in the longitudinal direction thereof.

Figure 3:
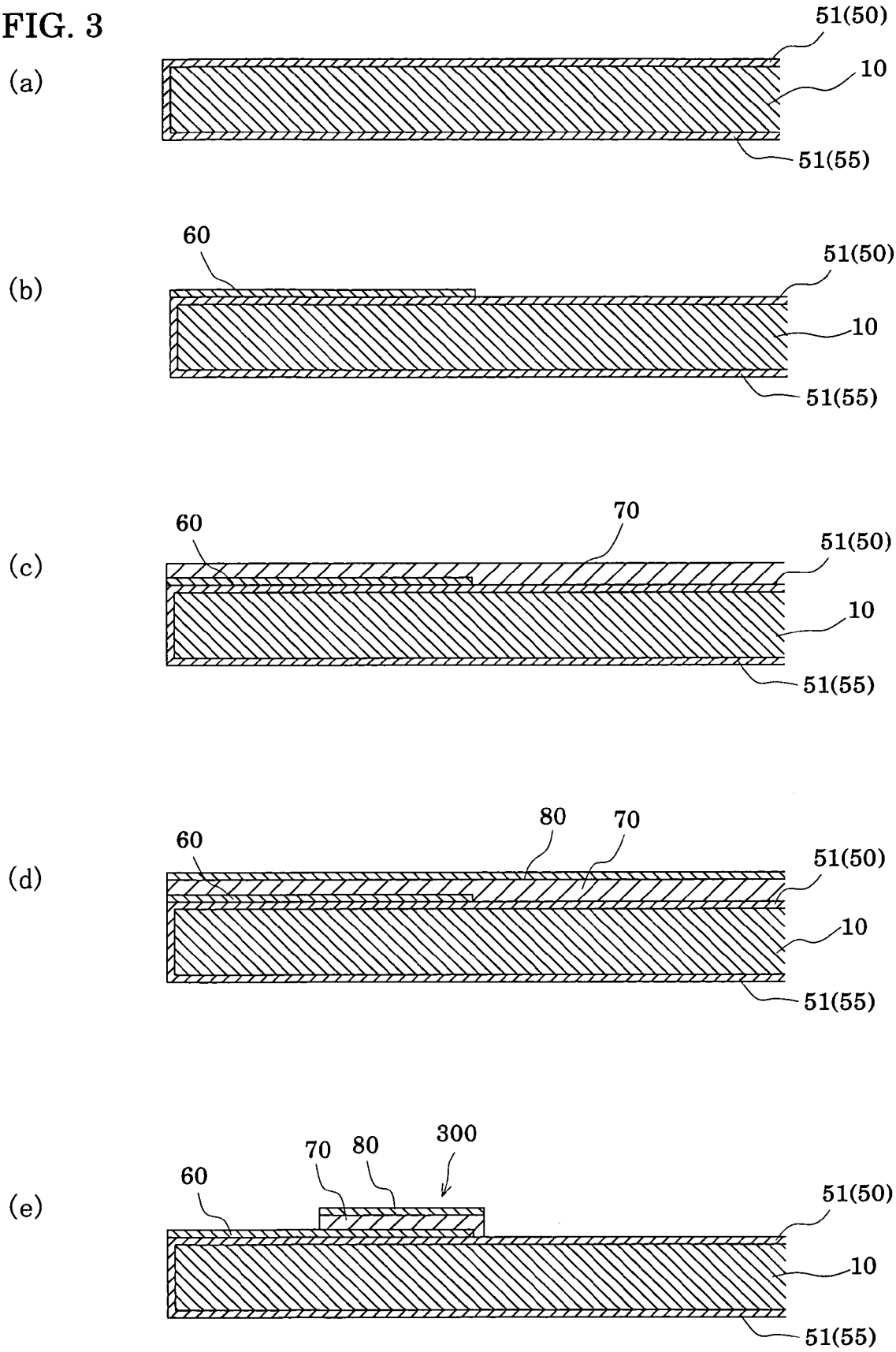
FIGS. 3(*a*) to 3(*e*) are sectional views showing a process of manufacturing the recording head according to Embodiment 1.

First, as shown in FIG. 3(*a*), a single crystal silicon substrate to become the passage-forming substrate 10 is thermally oxidized in a diffusion furnace at approximately 1100° C. to form, on the entire surface of the single crystal silicon substrate, a silicon dioxide film 51 to constitute the elastic film 50 and the insulation film 55. Subsequently, as shown in FIG. 3(*b*), the lower electrode film 60 is formed on the silicon dioxide film 51 to become the elastic film 50 by sputtering, and patterned into a predetermined shape. Platinum (Pt) or the like is suitable for a material for such a lower electrode film 60. This is because the undermentioned piezoelectric layer 70 deposited by sputtering or a sol-gel method needs to be baked and crystallized at a temperature of approximately 600 to 1000° C. in an ambient atmosphere or in an oxygen atmosphere after the deposition. That is, a material for the lower electrode film 60 must maintain conductivity in such a high-temperature oxygen atmosphere. In particular, when lead zirconate titanate (PZT) is used for the piezoelectric layer 70, it is desirable that a change in the conductivity due to the diffusion of lead oxide be small. For these reasons, platinum is suitable.

Next, as shown in FIG. 3(*c*), the piezoelectric layer 70 is deposited. The piezoelectric layer 70 preferably has oriented crystals. For example, in the present embodiment, the piezoelectric layer 70 having oriented crystals was formed using a so-called sol-gel method, in which the piezoelectric layer 70 made of metal oxide is obtained as follows: so-called sol, which is obtained by dissolving and dispersing metal-organic matter in catalyst, is applied and dried to be gelled, and further baked at high temperature. As a material for the piezoelectric layer 70, lead zirconate titanate materials are suitable for an ink-jet recording head. Note that a method of depositing the piezoelectric layer 70 is not particularly limited. For example, the piezoelectric layer 70 may be formed by sputtering. Further, a method of growing crystals at low temperature by high-pressure treatment in an alkaline solution may be used after a precursor film of lead zirconate titanate is formed by the sol-gel method, sputtering, or the like. In any case, the piezoelectric layer 70 thus deposited has priority orientation of crystals unlike a bulk piezoelectric material. Furthermore, in the present embodiment, the crystals are formed in columnar shapes in the piezoelectric layer 70. Incidentally, the priority orientation means a state where the orientations of crystals are not random but specific crystal planes are oriented almost in a constant direction. Moreover, a thin film having columnar crystals means a state where crystals in almost circular cylindrical shapes congregate in the surface direction to form a thin film while almost matching the central axes thereof with the thickness direction of the thin film. It is needless to say that a thin film formed of granular crystals with priority orientation may be used. Note that the piezoelectric layer thus manufactured through a thin film deposition process has a thickness of 0.2 to 5 μm in general.

Figure 4:
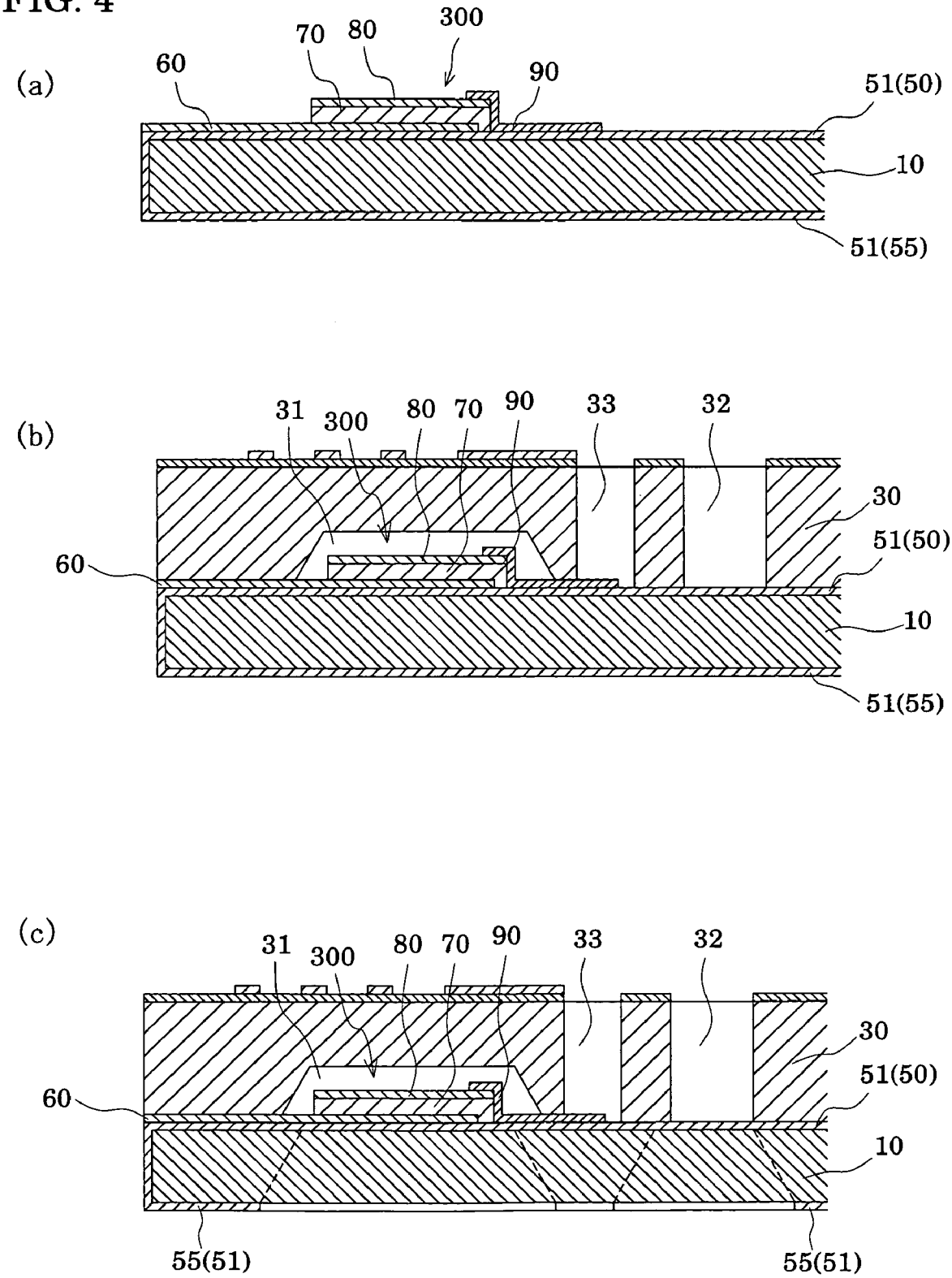
FIGS. 4(*a*) to 4(*c*) are sectional views showing the process of manufacturing the recording head according to Embodiment 1.

Next, as shown in FIG. 3(*d*), the upper electrode film 80 is deposited. The upper electrode film 80 can be sufficiently made of a material having high conductivity, and many kinds of metal including aluminum, gold, nickel, and platinum, conductive oxides, and the like can be used. In the present embodiment, platinum is deposited by sputtering. Subsequently, as shown in FIG. 3(*e*), the piezoelectric elements 300 are patterned by etching only the piezoelectric layer 70 and the upper electrode film 80. Next, as shown in FIG. 4(*a*), the lead electrodes 90 are formed. Specifically, for example, the lead electrode 90 made of gold (Au) or the like is formed over the entire surface of the passage-forming substrate 10 and patterned for each piezoelectric element 300. The above is a film forming process.

After the films have been formed as described above, the single crystal silicon substrate (passage-forming substrate 10) is anisotropically etched by using the aforementioned alkaline solution, thus forming the pressure generating chambers 12, the communicating portion 13, and the ink supply paths 14. Specifically, first, as shown in FIG. 4(*b*), the sealing plate 30, on which the piezoelectric element holding portion 31, the reservoir portion 32, the connection hole 33, and the like are formed in advance, is joined to the piezoelectric element 300 side of the passage-forming substrate 10.

Figure 5:
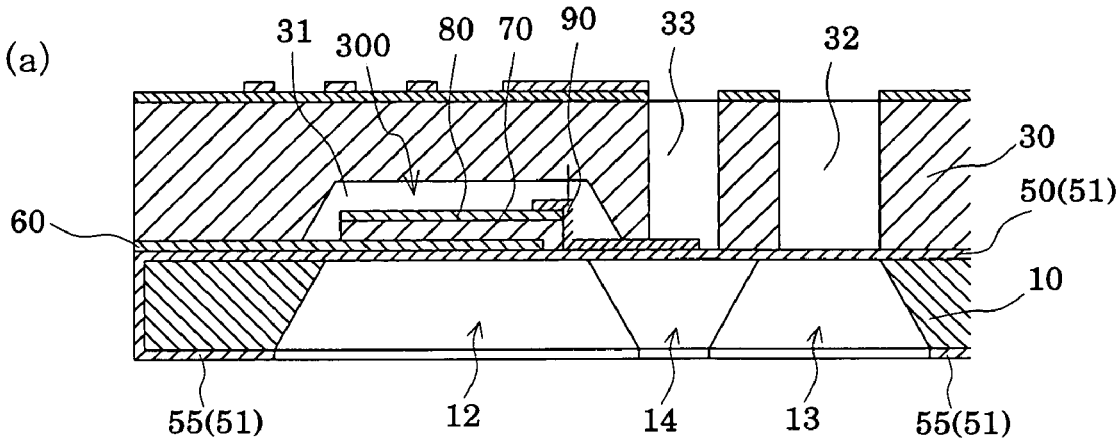
FIGS. 5(*a*) and 5(*b*) are sectional views showing the process of manufacturing the recording head according to Embodiment 1.
Figure 5:
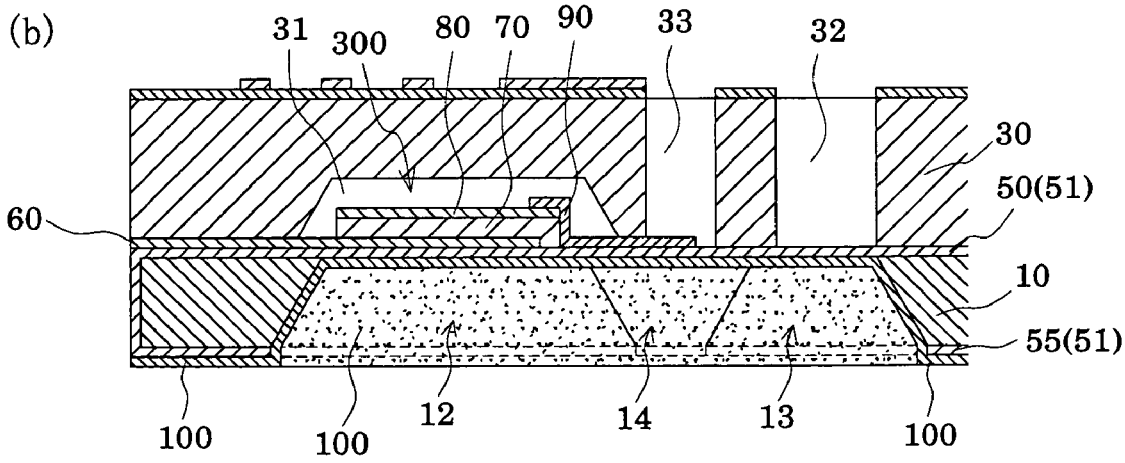

Next, as shown in FIG. 4(*c*), the insulation film 55 (silicon dioxide film 51) formed on the surface of the passage-forming substrate 10 is patterned into a predetermined shape. Subsequently, as shown in FIG. 5(*a*), the aforementioned anisotropic etching using the alkaline solution is performed through the insulation film 55, thereby forming the pressure generating chambers 12, the communicating portion 13, the ink supply paths 14, and the like in the passage-forming substrate 10. Note that the insulation film 55 is patterned and the passage-forming substrate 10 is anisotropically etched as described above in a state where the surface of the sealing plate 30 is sealed.

Thereafter, as shown in FIG. 5(*b*), the protective film 100 is formed on the inner wall surfaces of the pressure generating chambers 12, of the communicating portion 13, and of the ink supply paths 14 in the passage-forming substrate 10 under a temperature condition of 150° C. or lower. For example, in the present embodiment, the protective film 100 made of tantalum pentoxide ($Ta_2O_5$) was formed by ion assisted deposition under a temperature condition of 100° C. or lower. Note that, at this time, the protective film 100 is also formed on the surface of the passage-forming substrate 10 where the pressure generating chambers 12 and the like open, i.e., on the surface of the insulation film 55.

As described above, the protective film 100 is formed under the temperature condition of 150° C. or lower, in the present embodiment, under the temperature condition of 100° C. or lower. Accordingly, the protective film 100 can be relatively easily and favorably formed without the piezoelectric elements 300 and the like being adversely affected by heat. Moreover, under the temperature condition of 150° C. or lower, there is no need to be concerned about damage to the sealed spaces including the piezoelectric element holding portion 31 and the like, and therefore there is no possibility of the destruction of the piezoelectric elements 300 caused by moisture or the like entering the piezoelectric element holding portion 31.

Moreover, by use of tantalum pentoxide as a material for the protective film 100, the protective film 100 having excellent resistance to etching can be formed. Therefore, the passage-forming substrate 10 is not dissolved in ink, whereby ink ejecting characteristics can be kept constant for a long period.

Incidentally, after the protective film 100 is formed as described above, the elastic film 50 and the like in a region facing the communicating portion 13 are removed to make the communicating portion 13 and the reservoir portion 32 communicate with each other. Then, the nozzle plate 20 having the nozzle orifices 21 drilled therein is joined to the surface of the passage-forming substrate 10 on the opposite side to the sealing plate 30, and the compliance plate 40 is joined to the sealing plate 30. Thus, the ink-jet recording head of the present embodiment is formed. Further, in practice, a large number of chips are simultaneously formed on one wafer by the aforementioned series of film forming and anisotropic etching, and after the processes are completed, the wafer is divided into each passage-forming substrate 10 of one chip size as shown in FIG. 1.

Moreover, in the present embodiment, the protective film 100 is formed by ion assisted deposition. However, a method of forming the protective film 100 is not limited to this. For example, the protective film 100 may be formed by facing target sputtering. If this facing-target sputtering is used, a dense protective film can be also favorably formed under the temperature condition of 100° C. or lower, similarly to ion assisted deposition. Further, since the deposition rate is very high, the manufacturing efficiency is improved, and manufacturing cost can be also reduced. In addition, a denser protective film can be formed by reducing the pressure in a chamber to a relatively low level when the protective film 100 is formed.

Figure 6:
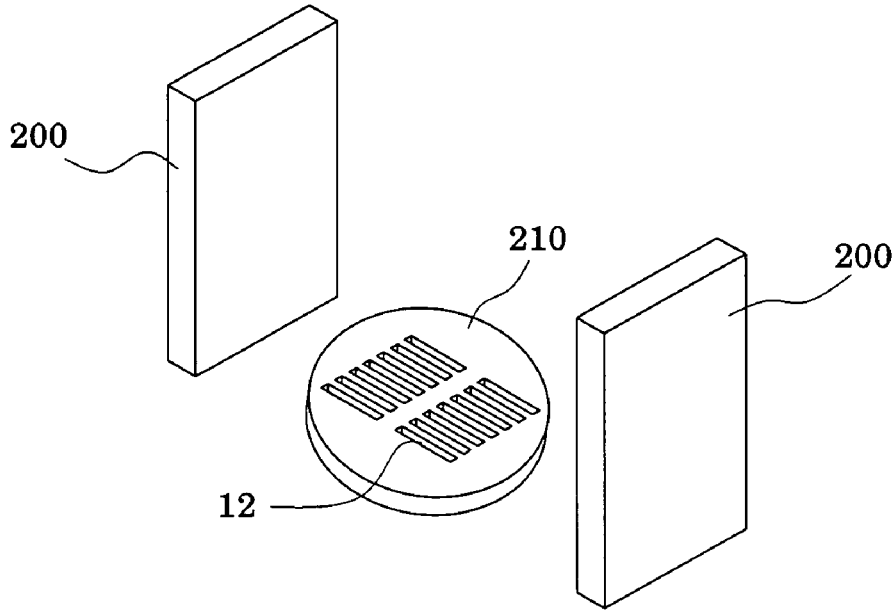
FIGS. 6(*a*) and 6(*b*) are schematic views showing another example of the process of manufacturing the recording head according to Embodiment 1.
Figure 6:
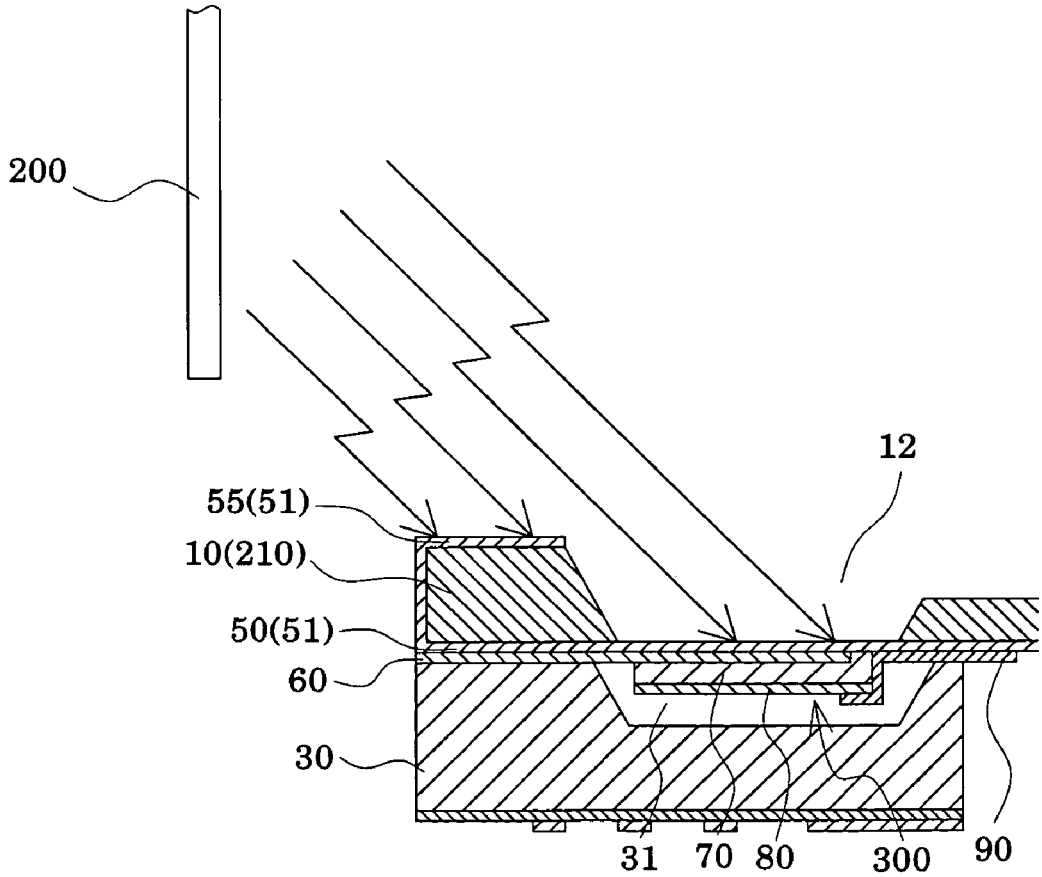

Moreover, when the protective film 100 is formed by facing target sputtering, it is preferable to place a wafer 210, which becomes the passage-forming substrate 10, so that the longitudinal direction of the pressure generating chambers 12 is at approximately 90 degrees to the direction (in FIG. 6(*b*) the vertical direction) of the surfaces of targets 200, as shown in FIGS. 6(*a*) and 6(*b*). Thus, atoms emitted from the targets 200 certainly attach to the inner surfaces of the pressure generating chambers 12 and the like even in a state where the wafer 200 is fixed. That is, the atoms emitted from the targets 200 move along the longitudinal direction of the pressure generating chambers 12 and therefore enter the pressure generating chambers 12 up to the bottoms thereof relatively uniformly. Accordingly, the protective film 100 can be formed to a uniform thickness on the inner surfaces of the pressure generating chambers 12 and the like. It is needless to say that the protective film 100 may be formed while the wafer 210 is being rotated in a surface direction thereof.

Figure 7:
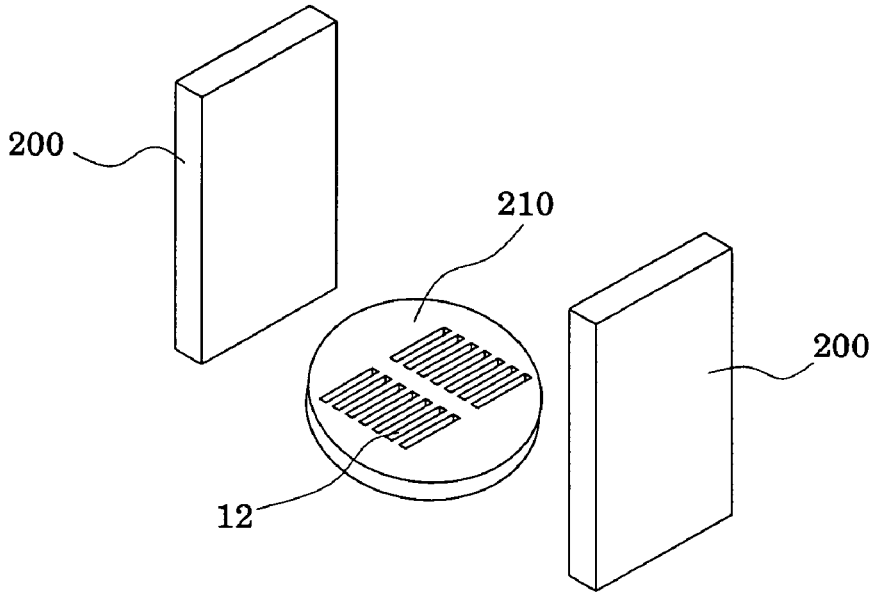
FIGS. 7(*a*) and 7(*b*) are schematic views showing an example of a process of manufacturing a recording head.
Figure 7:
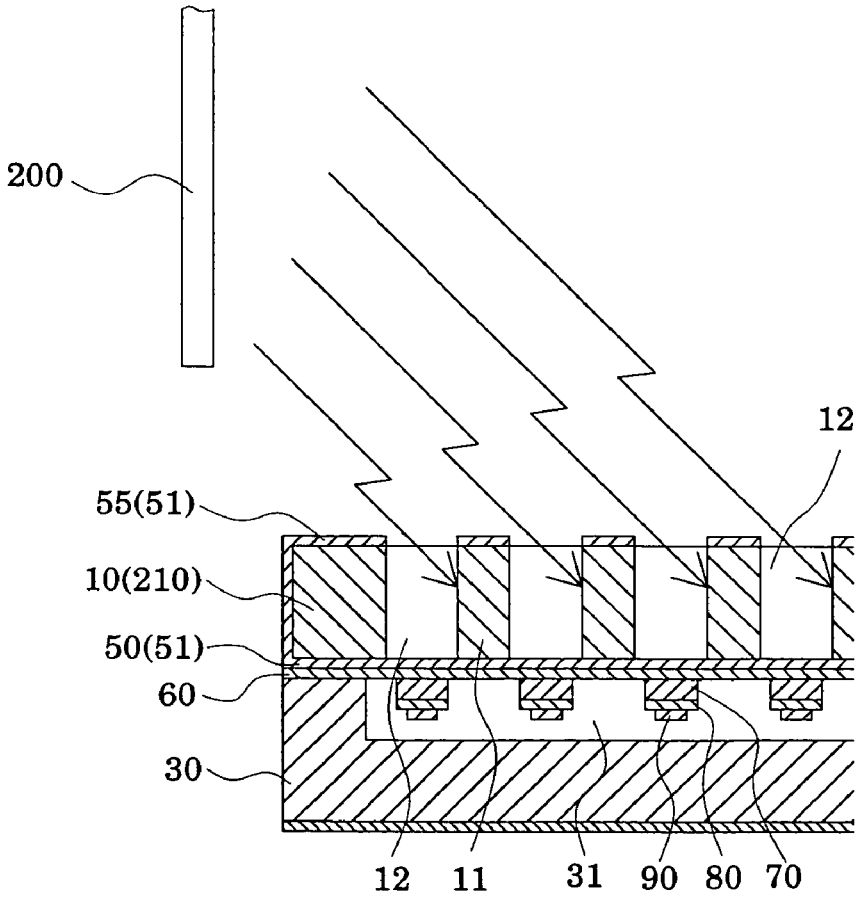

Note that, as shown in FIGS. 7(*a*) and 7(*b*), if the protective film 100 is formed in a state where the wafer 210 is placed so that the longitudinal direction of the pressure generating chambers 12 is parallel to the surface direction of the targets 200, atoms emitted from the targets 200 move along the width direction of the pressure generating chambers 12. Therefore, nonuniformity is caused in the depth to which the atoms enter and the like depending on the positions of the pressure generating chambers 12. Accordingly, the protective film 100 may not be formed over the entire inner surfaces of the pressure generating chambers 12 and the like, and variation may occur in the thickness of the protective film 100.

Figure 8:
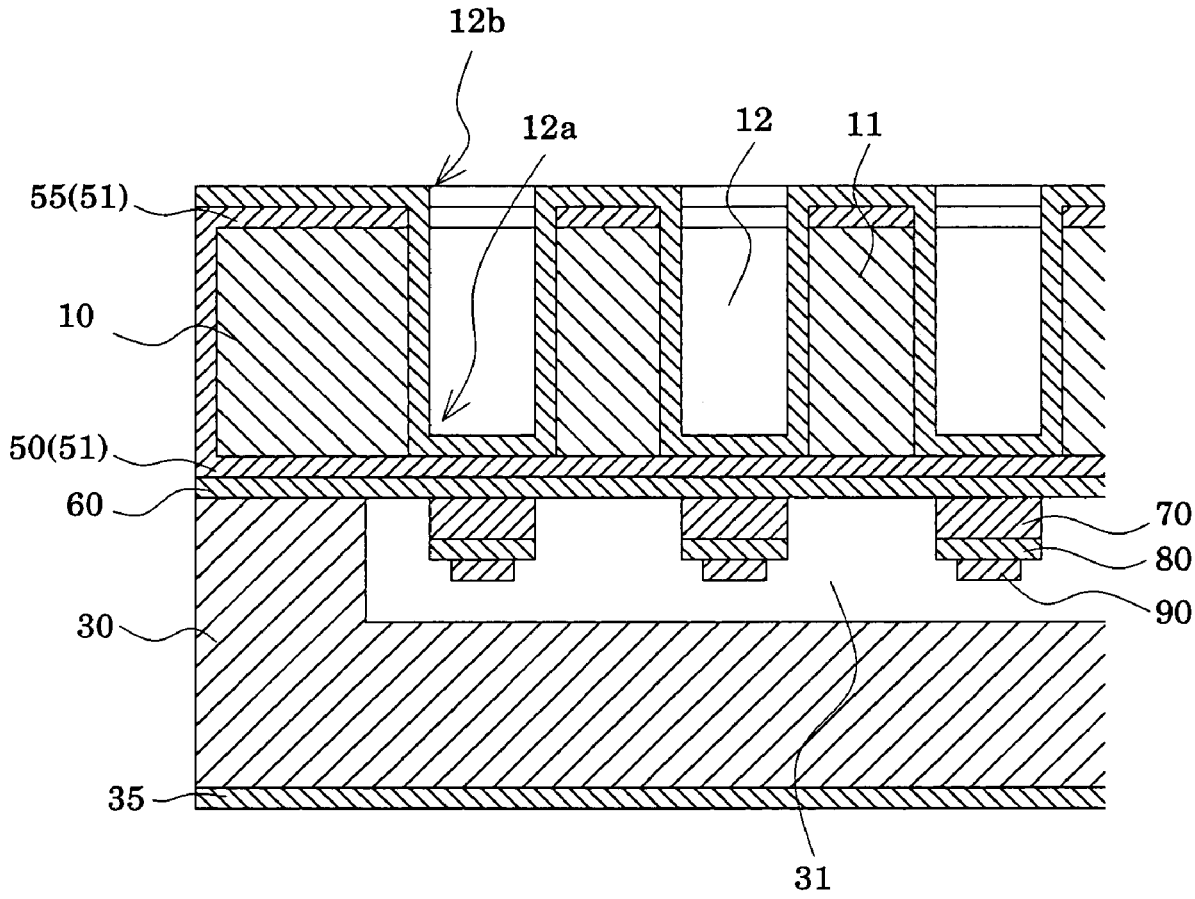
FIG. 8 is a sectional view showing another example of the recording head according to Embodiment 1.

Moreover, the protective film 100 may be formed by plasma chemical vapor deposition (CVD) instead of ion assisted deposition. By plasma CVD, a dense film can be also formed under the temperature condition of 150° C. or lower. In particular, when the protective film 100 is formed by plasma CVD, as shown in FIG. 8, the protective film 100 can be continuously and favorably formed even on corner portions 12*a* formed by the sides and the bottoms of the pressure generating chambers 12, peripheral portions 12*b* of the openings of the pressure generating chambers 12, and the like, by selecting predetermined conditions. Therefore, an ink-jet recording head in which durability and reliability are remarkably improved can be realized.

Note that a dense protective film can be also formed at relatively low temperature by other physical vapor deposition (PVD) or the like, for example, by electronic cyclotron resonance (ECR) sputtering or the like, other than ion assisted deposition, facing-target sputtering, plasma CVD, and the like.

Embodiment 2

Figure 9:
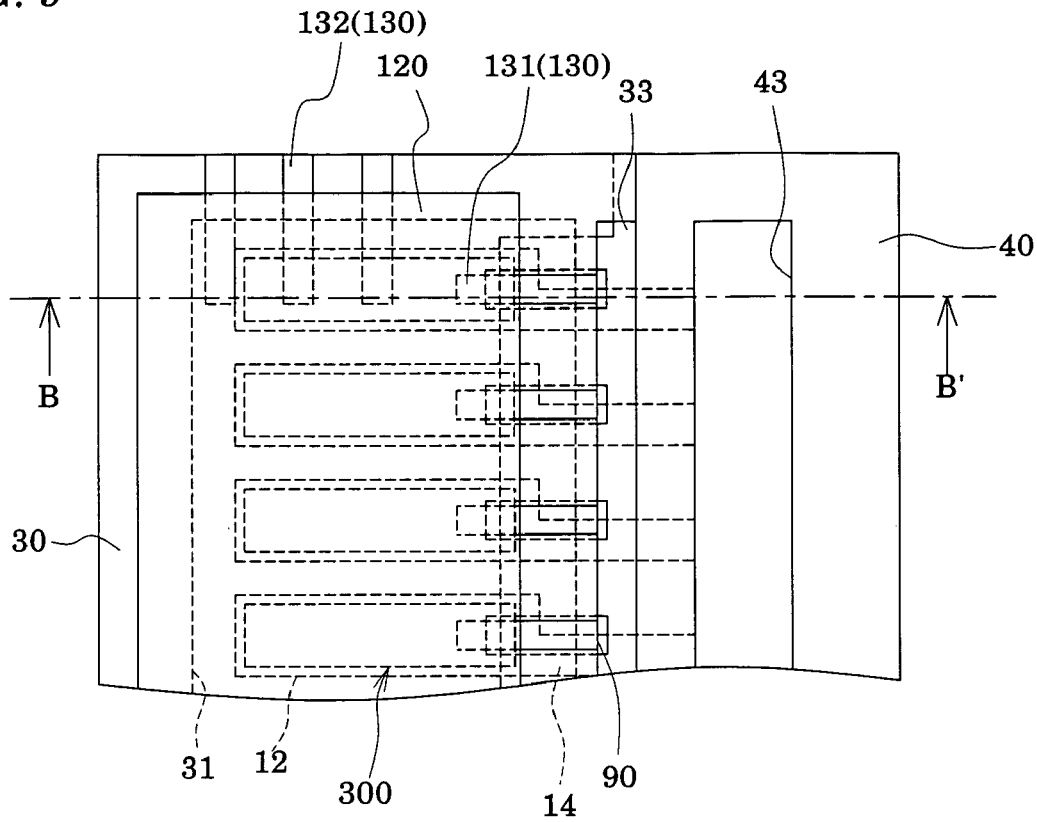
FIGS. 9(*a*) and 9(*b*) are a plan view and a sectional view of a recording head according to Embodiment 2, respectively.
Figure 9:
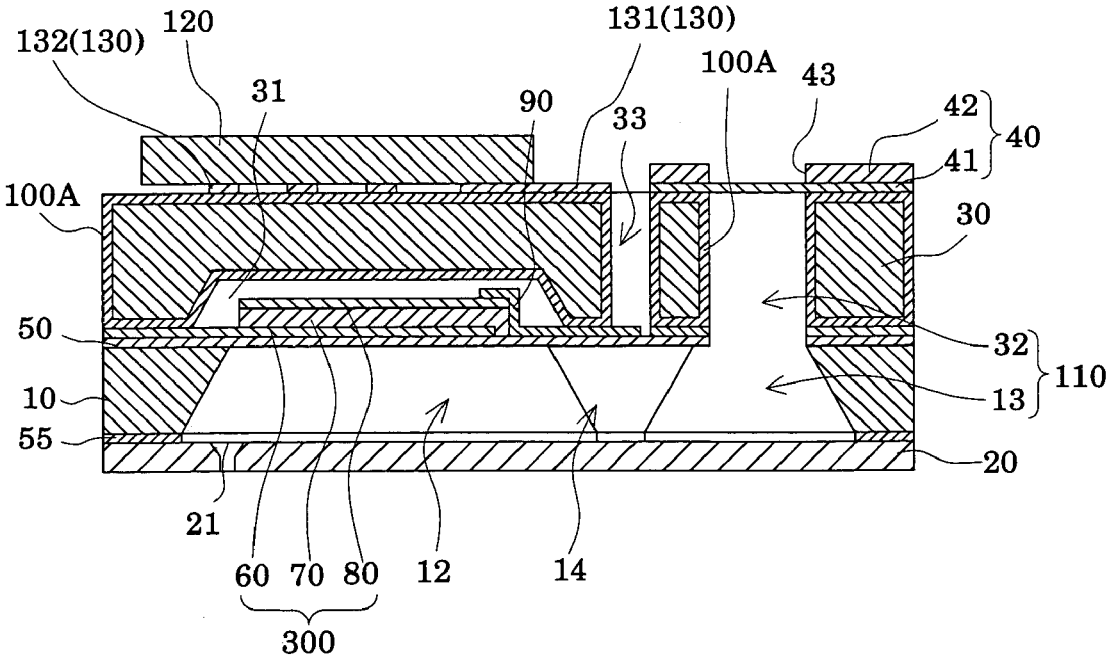

FIGS. 9(*a*) and 9(*b*) are a plan view and a sectional view of an ink-jet recording head according to Embodiment 2, respectively. The present embodiment is an example in which a protective film having resistance to ink is provided at least on the inner wall surface of the reservoir portion 32 in the sealing plate 30. That is, as shown in FIGS. 9(*a*) and 9(*b*), in the present embodiment, an ink-resistant protective film 100A is provided on the entire surface of the sealing plate 30 including the inner wall surface of the reservoir portion 32, thus preventing the inner wall surface of the reservoir portion in the sealing plate 30 from being dissolved by ink. Moreover, the interconnections 130 are provided on the protective film 100A provided on the surface of the sealing plate 30 on the opposite side to the passage-forming substrate 10, and the drive IC 120 is mounted on the interconnections 130. That is, the protective film 100A on the surface of the sealing plate 30 serves as the aforementioned insulation film.

By providing the protective film 100A on the inner wall surface of the reservoir portion 32 in the sealing plate 30 as described above, it is possible to prevent the sealing plate 30 from being dissolved in ink, and the shape of the reservoir portion 32 is maintained almost the same as when manufactured for a long period. That is, by providing the protective film 100A, the shape of the reservoir portion 32 is substantially stabilized, and ink is favorably supplied to each pressure generating chamber 12. Accordingly, ink ejecting characteristics can be stabilized for a long period. Furthermore, the amount of deposits in ink separated out of dissolved materials of the sealing plate 30 dissolved in the ink, is satisfactorily reduced, thereby preventing the occurrence of nozzle blockage. Thus, ink droplets can always be favorably ejected from the nozzle orifices 21.

Note that a material for the protective film 100A is not particularly limited as long as it has resistance to ink. For example, in the present embodiment, silicon dioxide is used. Moreover, the thickness of the protective film 100A is not particularly limited. For example, the protective film 100A with a thickness of approximately 1.0 μm, can certainly prevent the sealing plate 30 from being dissolved by ink.

Here, a method of manufacturing the ink-jet recording head of the present embodiment as described above, particularly a process of forming the sealing plate 30, will be described with reference to FIGS. 10(*a*) to 10(*e*). Incidentally, FIGS. 10(*a*) to 10(*e*) are sectional views of the piezoelectric element holding portion in the longitudinal direction thereof.

Figure 10:
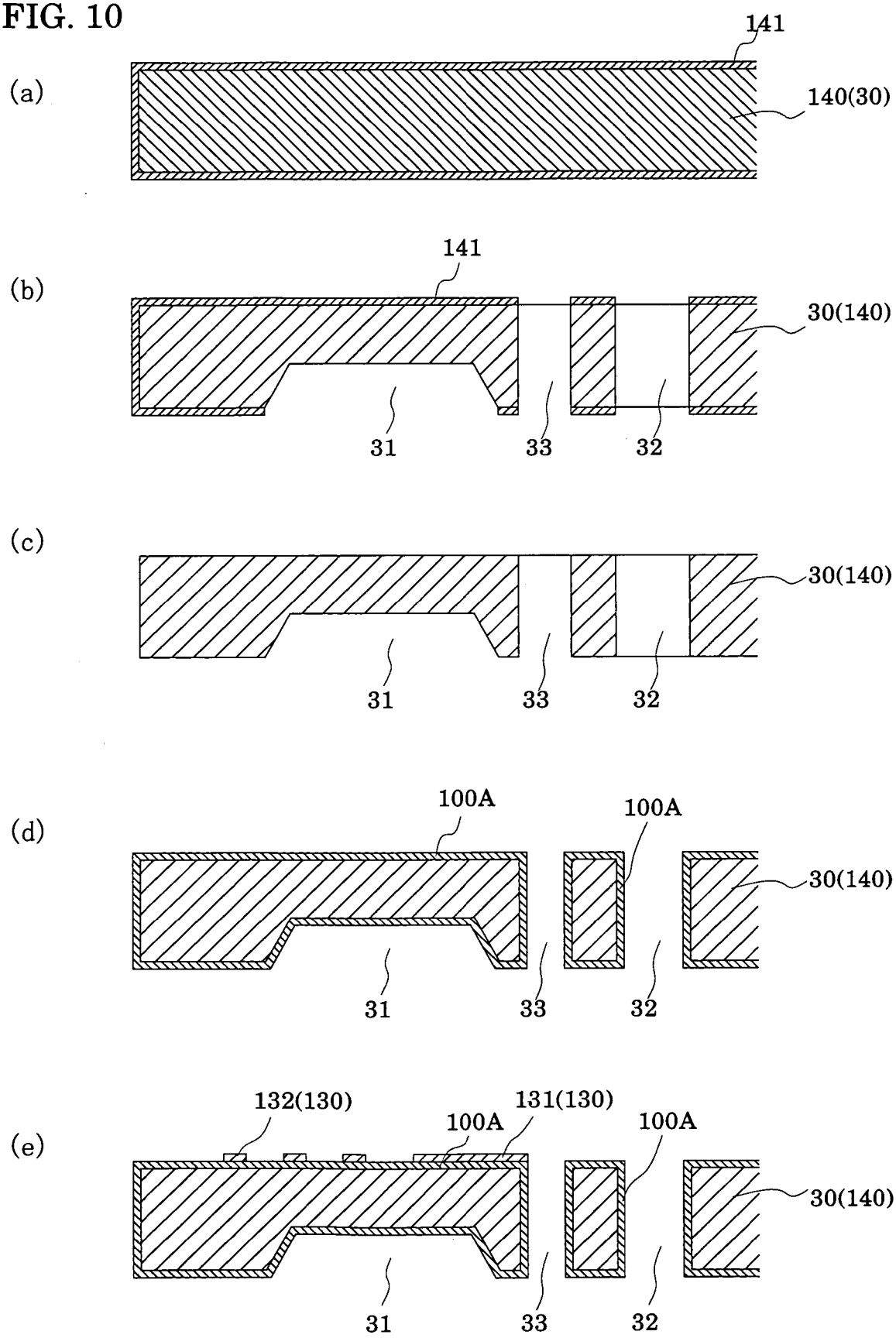
FIGS. 10(*a*) to 10(*e*) are sectional views showing a process of manufacturing the recording head according to Embodiment 2.

First, as shown in FIG. 10(*a*), a sealing plate forming material 140, made of a single crystal silicon substrate, to become the sealing plate 30 is thermally oxidized in a diffusion furnace at approximately 1100° C. to form a silicon dioxide film 141 on the entire surface of the sealing plate forming material 140. Note that the silicon dioxide film 141, which is to be described in detail later, is used as a mask when the sealing plate forming material 141 is etched. Next, as shown in FIG. 10(*b*), the silicon dioxide film 141 formed on one surface of the sealing plate forming material 140 is patterned into a predetermined shape. Then, using this silicon dioxide film 141 as a mask pattern, the sealing plate forming material 140 is anisotropically etched by using an alkaline solution similarly to the aforementioned pressure generating chambers 12, thus forming the sealing plate 30. That is, the piezoelectric element holding portion 31, the reservoir portion 32, and the penetrated hole 33 are formed in the sealing plate forming material 140 by anisotropic etching.

Subsequently, as shown in FIG. 10(*c*), the silicon dioxide film 141 is removed. Specifically, for example, the silicon dioxide film 141 on the surface of the sealing plate 30 is removed using an etchant such as hydrofluoric acid (HF). Next, as shown in FIG. 10(*d*), the ink-resistant protective film 100A is formed at least on the inner wall surface of the reservoir portion 32 in the sealing plate 30. In the present embodiment, the protective film 100A having resistance to ink is formed on the entire surface of the sealing plate 30 including the inner wall surface of the reservoir portion 32 by thermally oxidizing the sealing plate 30. Note that, in the present embodiment, since the sealing plate 30 is made of a single crystal silicon substrate, the protective film 100A is made of silicon dioxide.

Subsequently, as shown in FIG. 10(*e*), the interconnections 130 are formed into predetermined shapes on the protective film 100A on the surface of the sealing plate 30 on the opposite side to the piezoelectric element holding portion 31 side. Note that, in the present embodiment, the interconnections 130 are formed into predetermined shapes by using a roll coater method. However, the interconnections 130 may be formed by using, for example, a thin film forming method such as lithography. Thereafter, the sealing plate 30 is joined to the passage-forming substrate 10 provided with the piezoelectric elements 300, and then processes similar to that of Embodiment 1 are conducted. Thus, the ink-jet recording head of the present embodiment is formed.

In the manufacturing method according to the present embodiment as described above, the entire sealing plate 30 is thermally oxidized, whereby the protective film 100A is formed on the entire surface of the sealing plate 30 in a single thermal oxidation step. Accordingly, work of forming the protective film 100A can be simplified. Moreover, the protective film 100A is formed to an almost uniform thickness in a state where no pinholes are generated. Therefore, the interconnections 130 and the sealing plate 30 can be certainly insulated by forming the interconnections 130 on the protective film 100A.

Embodiment 3

Figure 11:
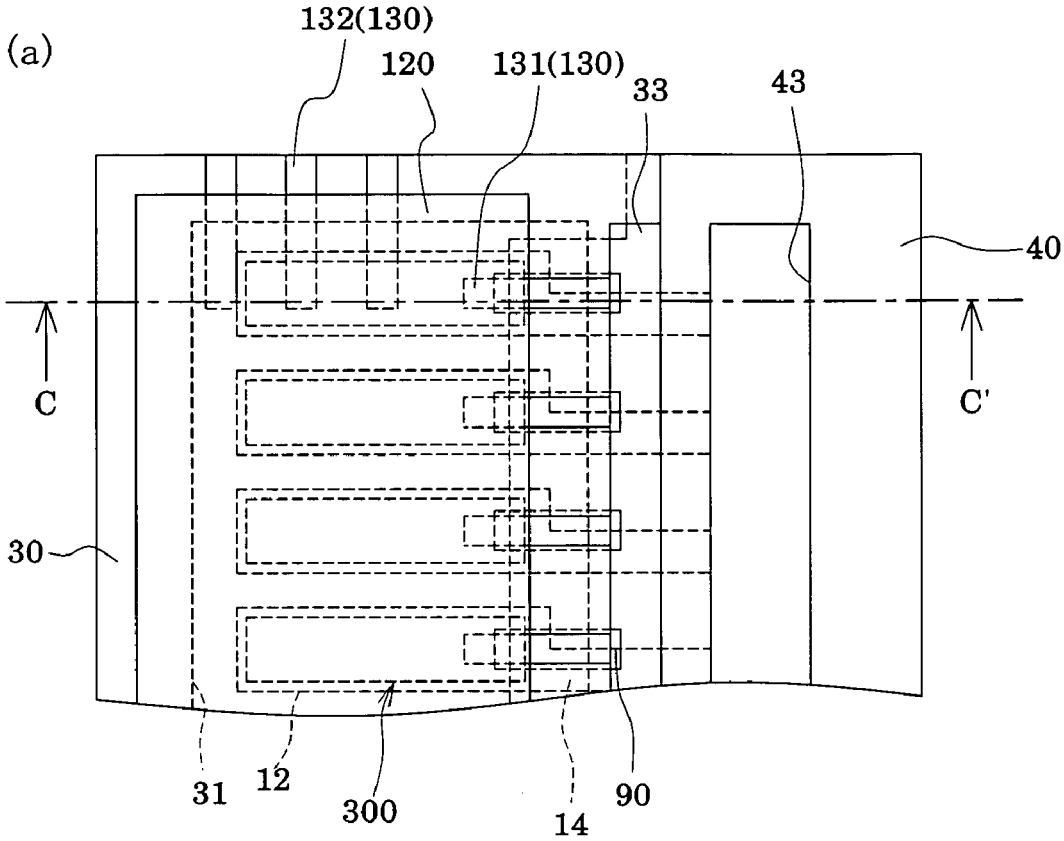
FIGS. 11(*a*) and 11(*b*) are a plan view and a sectional view of a recording head according to Embodiment 3, respectively.
Figure 11:
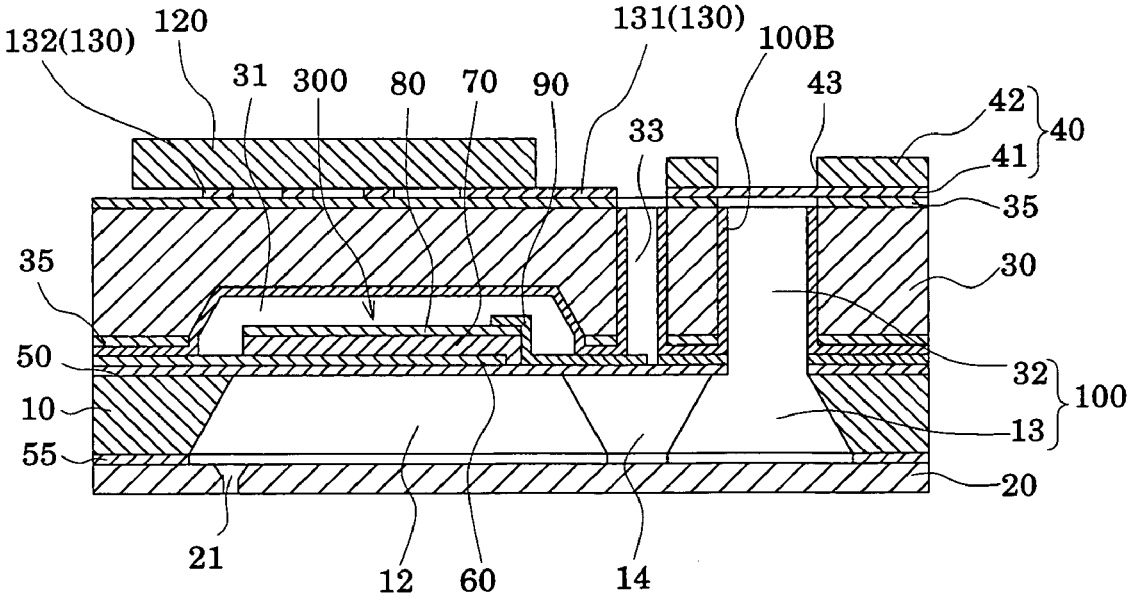

FIGS. 11(*a*) and 11(*b*) are a plan view and a sectional view of an ink-jet recording head according to Embodiment 3, respectively. The present embodiment is another example of a protective film provided on the sealing plate. As shown in FIGS. 11(*a*) and 11(*b*), the present embodiment is the same as Embodiment 2 except that a protective film 100B, which is made of dielectric material and has resistance to ink (erosion resistance to ink), is formed on the inner wall surfaces of the piezoelectric element holding portion 31, of the reservoir portion 32, and of the penetrated hole 33 in the sealing plate 30, and on the joint surface of the sealing plate 30 with the passage-forming substrate 10 by physical vapor deposition (PVD) such as sputtering.

Also in such a structure, the sealing plate 30 can be prevented from being dissolved by ink, and the shape of the reservoir portion 32 can be maintained almost the same as when manufactured for a long period. Moreover, since the sealing plate 30 can be prevented from being dissolved in ink, dissolved materials of the sealing plate 30 are not separated in the ink, thereby preventing the occurrence of nozzle blockage caused by deposits.

Furthermore, the shape of the reservoir portion 32 is stabilized by the protective film 100B, and the flow of ink is kept constant. Accordingly, bubbles are not mixed into the ink, and the ink can be favorably supplied to each pressure generating chamber 12. Thus, the effect of stabilizing ink ejecting characteristics for a long period can also be expected.

Here, a method of manufacturing the ink-jet recording head according to the present embodiment, particularly a method of manufacturing the sealing plate, will be described with reference to FIGS. 12(*a*) to 12(*e*). Incidentally, FIGS. 12(*a*) to 12(*e*) are sectional views showing a process of manufacturing the sealing plate.

Figure 12:
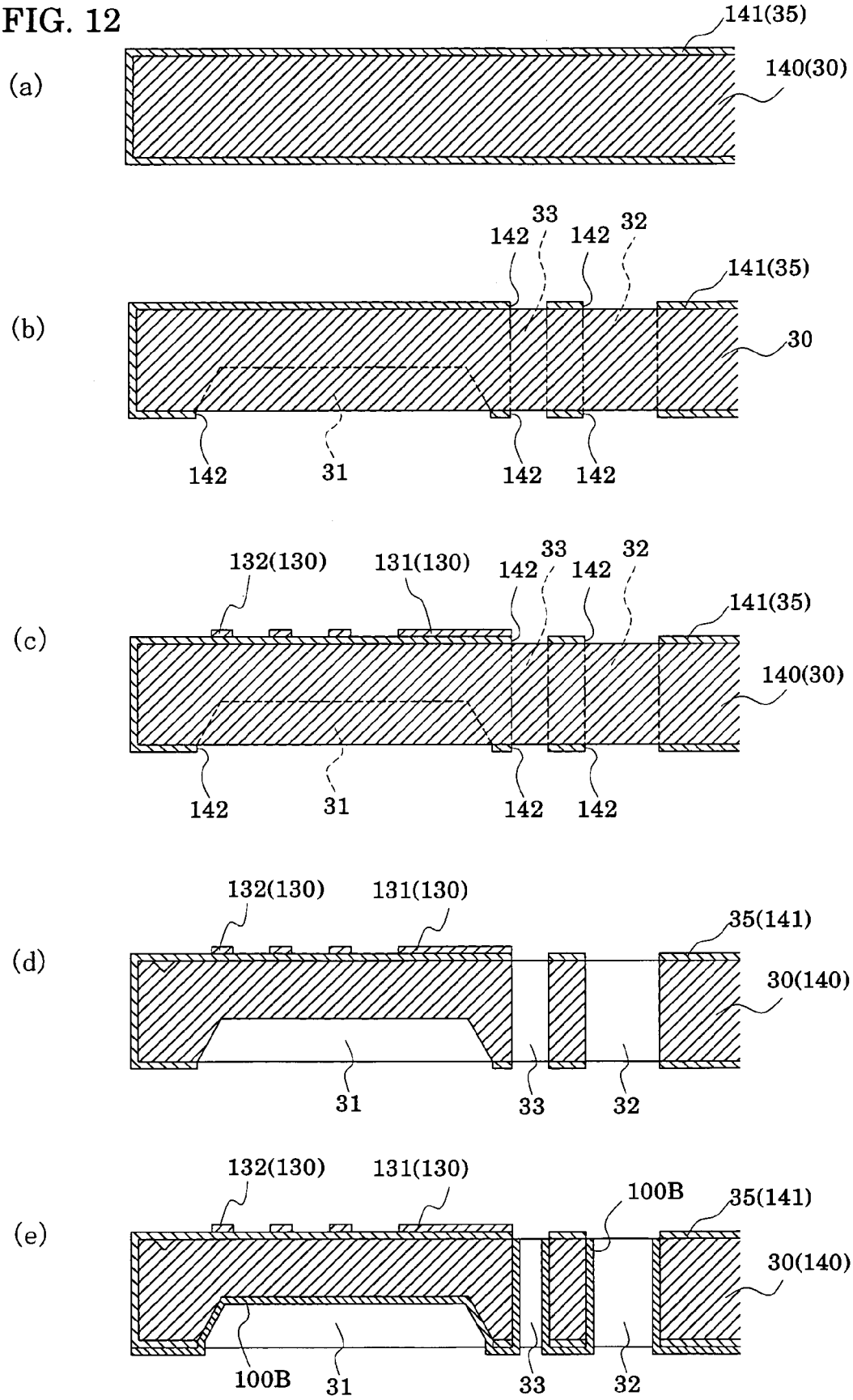
FIGS. 12(*a*) to 12(*e*) are sectional views showing a process of manufacturing the recording head according to Embodiment 3.

First, as shown in FIG. 12(*a*), a sealing plate forming material 140 made of a single crystal silicon substrate is thermally oxidized in a diffusion furnace at approximately 1100° C., thus forming a silicon dioxide film 141 to become an insulation film 35 and at the same time a mask for use in etching the sealing plate 30, on the entire surface of the sealing plate forming material 140. Next, as shown in FIG. 12(*b*), the silicon dioxide film 140 is patterned, thereby forming opening portions 141 in respective regions of the sealing plate 30 where the piezoelectric element holding portion 31, the reservoir portion 32, and the penetrated hole 33 are formed. Note that the opening portion 141 corresponding to the piezoelectric element holding portion 31 is formed on only one side of the sealing plate 30 while the opening portions 141 corresponding to the reservoir portion 32 and the penetrated hole 33 are formed on both sides of the sealing plate 30.

Subsequently, as shown in FIG. 12(*c*), the interconnections 130 are formed on the entire surface of the silicon dioxide film 141 (insulation film 35) on the surface of the sealing plate 30, for example, using a roll coater method or the like. Next, as shown in FIG. 12(*d*), the sealing plate forming material 140 is anisotropically etched through the silicon dioxide film 140, thus forming the sealing plate 30. That is, the sealing plate forming material 140 is anisotropically etched from the opening portions 141 of the silicon dioxide film 140, thereby forming the piezoelectric element holding portion 31, the reservoir portion 32, and the penetrated hole 33.

Next, as shown in FIG. 12(*e*), the protective film 100B, which is made of dielectric material and has resistance to ink, is formed on the inner wall surface of the reservoir portion 32 by physical vapor deposition (PVD) such as sputtering. For example, in the present embodiment, the protective film 100B is formed from the joint surface of the sealing plate 30 with the passage-forming substrate 10, i.e., from the piezoelectric element holding portion 31 side, by physical vapor deposition or the like. Accordingly, the protective film 100B is formed not only on the inner wall surface of the reservoir portion 32 but also on the inner wall surfaces of the piezoelectric element holding portion 31 and of the penetrated hole 33, and on the joint surface of the sealing plate 30 with the passage-forming substrate 10.

Here, the dielectric material used for the protective film 100B is not particularly limited. However, for example, it is preferable to use tantalum oxide, silicon nitride, aluminum oxide, zirconium oxide, or titanium oxide. Thus, the protective film 100B which is excellent in resistance to ink can be formed. Incidentally, in the present embodiment, tantalum pentoxide is used as the material for the protective film 100B.

Moreover, the protective film 100B as described above is preferably formed by physical vapor deposition (PVD), particularly by reactive ECR sputtering, facing-target sputtering, ion beam sputtering, or ion assisted deposition. This makes it possible to form the protective film 100B at a relatively low temperature of, for example, approximately 100° C., and therefore the interconnections 130 and the like provided on the sealing plate 30 are not adversely affected by heat and the like.

Further, by forming the protective film 100B by the above-mentioned method, the membrane stress in the protective film 100B can be restricted low, and the sealing plate 30 can be prevented from warping. Accordingly, the sealing plate 30 and the passage-forming substrate 10 can be favorably jointed in the undermentioned process.

Note that the surface of the sealing plate 30, i.e., the surface where the interconnections 130 are formed, is preferably protected with a predetermined jig or the like. This makes it possible to more easily and more favorably form the protective film 100B.

After the protective film 100B as described above is formed, the sealing plate 30 is joined to the passage-forming substrate 10, and processes similar to those of the aforementioned embodiments are conducted. Thus, the ink-jet recording head of the present embodiment is formed.

Other Embodiments

Although the embodiments of the present invention have been described above, it is needless to say that the present invention is not limited to the aforementioned embodiments.

Figure 13:
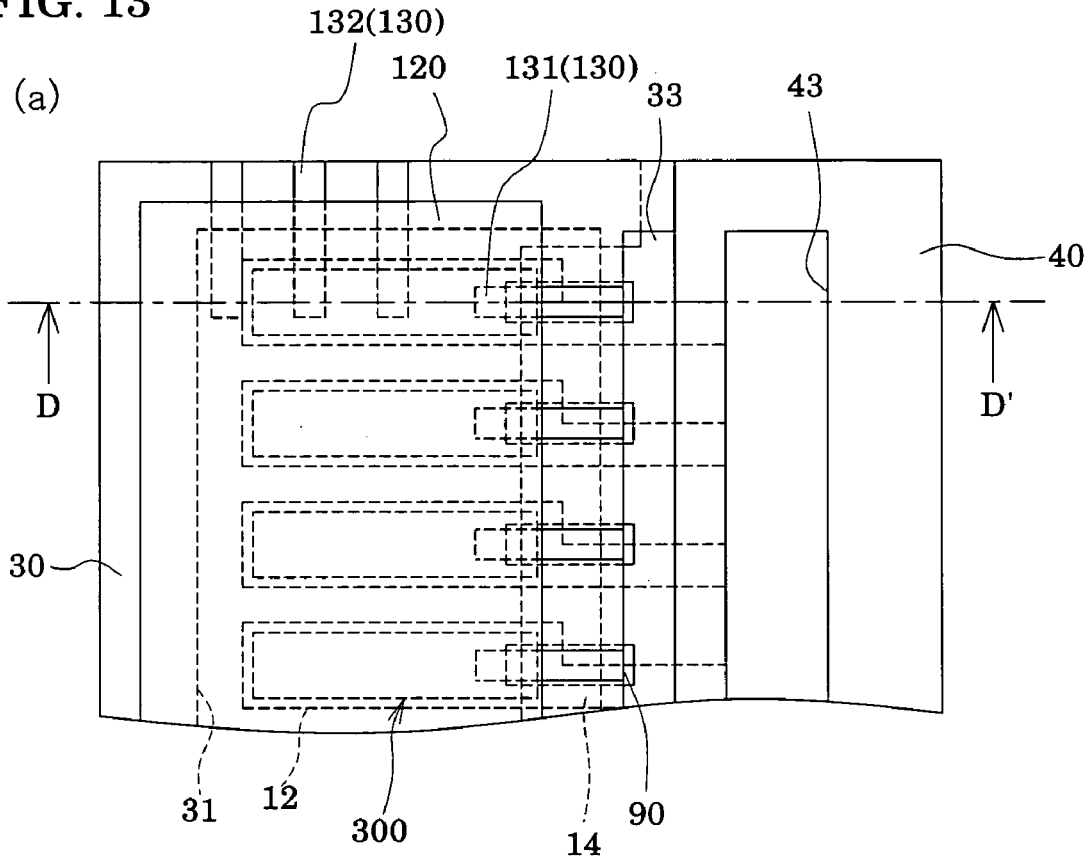
FIGS. 13(*a*) and 13(*b*) are a plan view and a sectional view of a recording head according to another embodiment, respectively.
Figure 13:
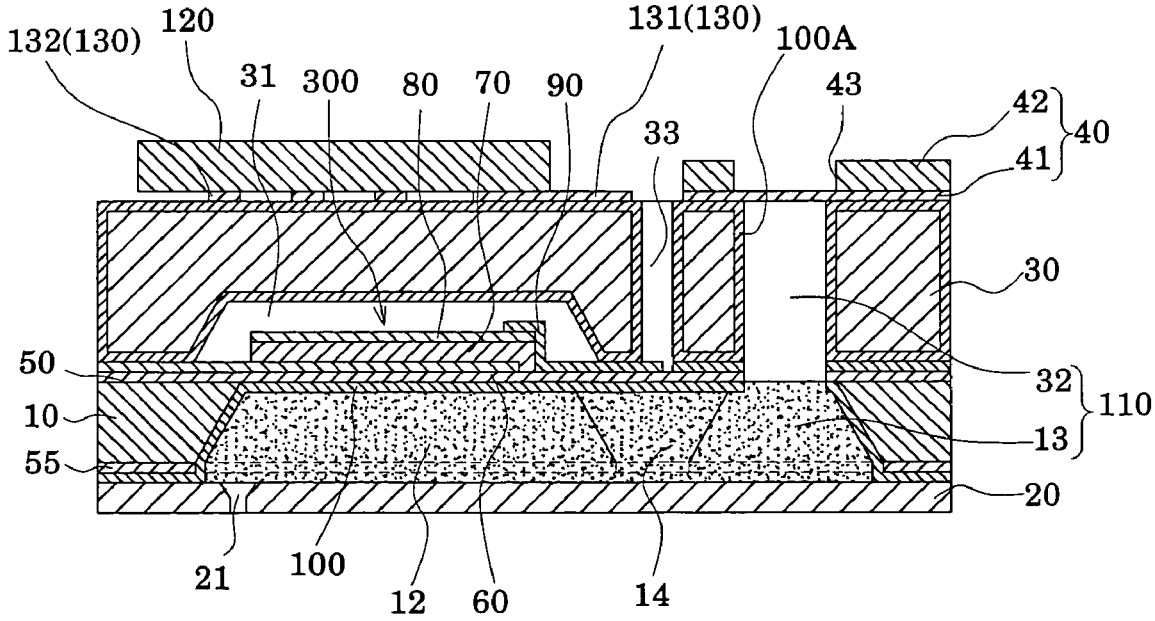

For example, in the aforementioned Embodiment 1, the protective film 100 is provided on the inner wall surfaces of the pressure generating chambers 12, of the communicating portion 13, and of the ink supply paths 14, which are formed in the passage-forming substrate 10. In Embodiments 2 and 3, the protective film 100A or 100B is provided on the inner wall surface of the reservoir portion 32 provided in the sealing plate 20. However, the present invention is not limited to these. For example, as shown in FIGS. 13(*a*) and 13(*b*), the protective film 100 made of tantalum oxide is provided on the inner surfaces of the pressure generating chambers 12 and the like in the passage-forming substrate 10, and at the same time the ink-resistant protective film 100A may be provided on the inner wall surfaces of the reservoir portion 32 and the like in the sealing plate 30, as a matter of course.

Moreover, for example, in the aforementioned Embodiments 2 and 3, the protective film 100A or 100B having resistance to ink is provided also in the other regions of the sealing plate 30 than the inner wall surface of the reservoir portion 32. However, it is needless to say that the protective film 100A or 100B may be provided only on the inner wall surface of the reservoir portion 32.

Further, in the aforementioned embodiments, the nozzle plate 20 made of stainless steal has been shown as an example. However, the nozzle plate 20 may be a nozzle plate made of silicon. Note that, in this case, since the nozzle plate is dissolved in ink, it is preferable to provide a protective film at least on the surface of the nozzle plate within each pressure generating chamber.

Furthermore, in the aforementioned embodiments, the ink-jet recording head of a flexure vibration type which uses the piezoelectric elements as pressure generating elements, has been described. However, the present invention is not limited to this as a matter of course. For example, the present invention can be applied to ink-jet recording heads of various structures, such as an ink-jet recording head of a longitudinal vibration type and an ink-jet recording head of an electrothermal conversion type in which resistance wires are provided in pressure generating chambers. In addition, in the aforementioned embodiments, the ink-jet recording head of a thin film type manufactured by applying deposition and lithography processes, has been taken as an example. However, the present invention is not limited to this as a matter of course. For example, the present invention can be also employed in an ink-jet recording head of a thick film type which is formed by a method of adhering a green sheet, or the like.

Figure 14:
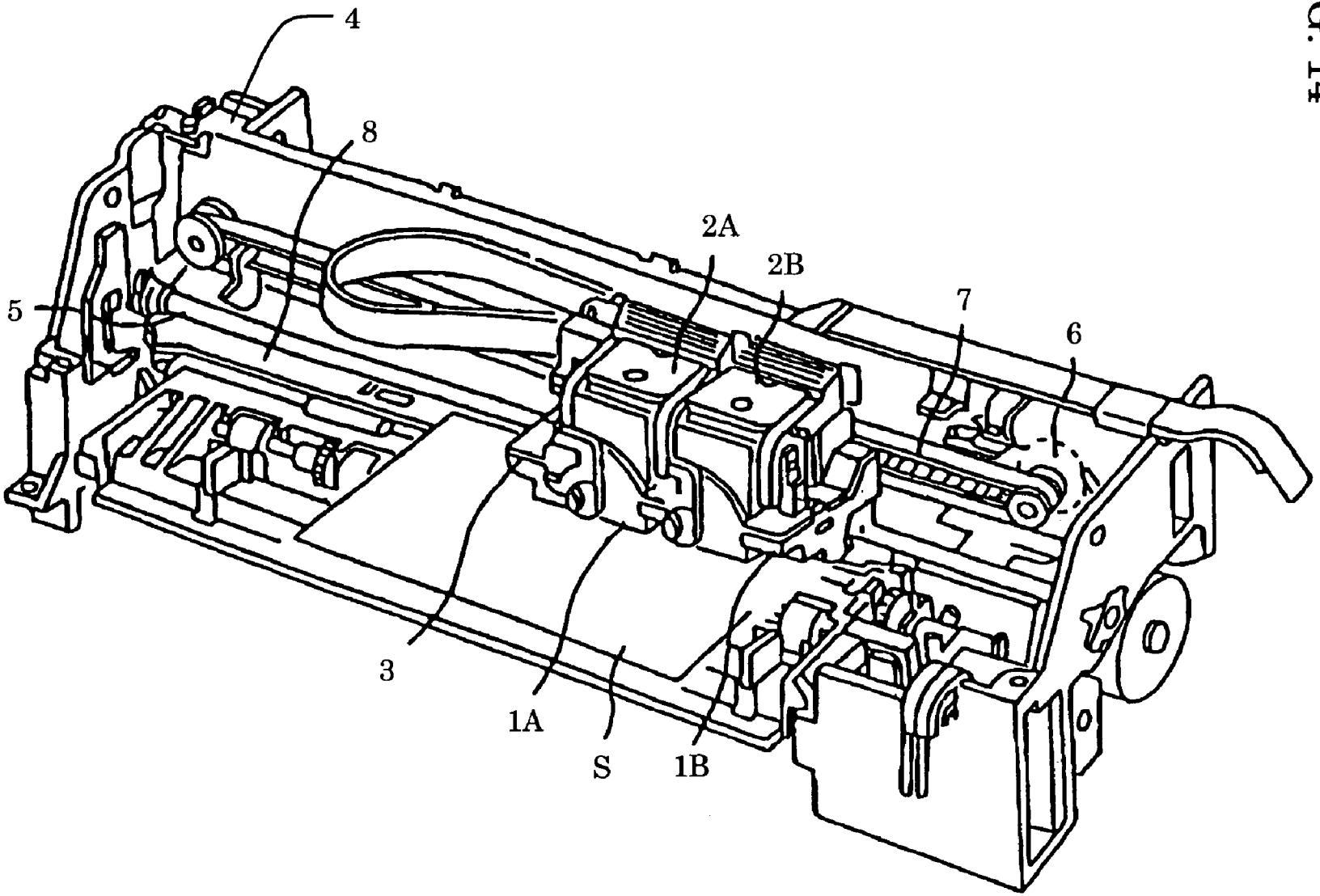
FIG. 14 is a schematic view of a recording apparatus according to one embodiment.

Moreover, the ink-jet recording head as described above constitutes part of a recording head unit provided with an ink passage communicating with an ink cartridge and the like to be mounted on an ink-jet recording apparatus. FIG. 14 is a schematic view showing an example of the ink-jet recording apparatus. As shown in FIG. 14, recording head units 1A and 1B having ink-jet recording heads are detachably provided with cartridges 2A and 2B constituting ink supply means. A carriage 3 having these recording head units 1A and 1B mounted thereon is provided on a carriage shaft 5, which is attached to an apparatus body 4, so as to freely move in an axial direction of the carriage shaft 5. The recording head units 1A and 1B eject, for example, a black ink composition and a color ink composition, respectively.

The driving force of a drive motor 6 is transmitted to the carriage 3 through a plurality of gears (not shown) and a timing belt 7, whereby the carriage 3 having the recording head units 1A and 1B mounted thereon is moved along the carriage shaft 5. Meanwhile, a platen 8 is provided in the apparatus body 4 along the carriage shaft 5, and a recording sheet S, which is a recording medium such as paper fed by a paper feeding roller (not shown) or the like, is conveyed on the platen 8.

Note that, in the aforementioned embodiments, the ink-jet recording head has been described as an example of a liquid jet head of the present invention. However, the basic structure of the liquid jet head is not limited to the aforementioned ones. The present invention broadly covers liquid jet heads in general. As a matter of course, the present invention is also applied to one which jets alkaline liquid other than ink. Other liquid jet heads include, for example, various kinds of recording heads used in an image recording apparatus such as a printer, a color material jet head used for manufacturing color filters of liquid crystal displays and the like, an electrode material jet head used for forming electrodes of organic EL displays, field emission displays (FEDs) and the like, and a bio-organic matter jet-head used for manufacturing biochips. If, as described above, the present invention is applied to a liquid jet head which jets alkaline liquid, the same excellent effects as those of the aforementioned embodiments can be obtained.

The invention claimed is:

1. A method of manufacturing a liquid jet head including a passage-forming substrate in which pressure generating chambers communicating with nozzle orifices for jetting liquid are formed; piezoelectric elements which are provided on one side of the passage-forming substrate with a vibration plate interposed therebetween and cause pressure changes in the pressure generating chambers; and a sealing plate which is made of a single crystal silicon substrate and has a piezoelectric element holding portion for sealing a space sufficient enough so as not to inhibit movement of the piezoelectric elements in a state where the space is ensured, the sealing plate further having a reservoir portion constituting at least part of a reservoir communicating with the pressure generating chambers, the method comprising the steps of:

forming a mask pattern on a surface of a sealing plate forming material, which becomes the sealing plate;

forming the reservoir portion and the piezoelectric element holding portion by etching the sealing plate forming material except a region where the mask pattern has been formed;

removing the mask pattern to form the sealing plate;

forming a protective film having resistance to liquid at least on an inner wall surface of the reservoir portion in the sealing plate; and joining the passage-forming substrate, in which the piezoelectric elements have been formed, and the sealing plate.

2. The method according to claim 1, wherein the protective film is formed on an entire surface of the sealing plate including the inner wall surface of the reservoir portion.

3. The method according to claim 1, wherein the protective film made of silicon dioxide is formed by thermally oxidizing the sealing plate.

4. The method according to claim 1, further comprising the step of:

forming interconnections for connecting the piezoelectric elements and a drive IC for driving the piezoelectric elements, on the protective film of the sealing plate on an opposite side to the piezoelectric element holding portion, after the step of forming the protective film.

5. The method according to claim 1, wherein the protective film made of dielectric material is formed by physical vapor deposition (PVD).

6. The method according to claim 5, wherein the protective film is formed by any one of reactive ECR sputtering, facing-target sputtering, ion beam sputtering, and ion assisted deposition.

7. The method according to claim 5, wherein the protective film is made of any one of tantalum oxide, silicon nitride, aluminum oxide, zirconium oxide, and titanium oxide.

8. The method according to claim 5, wherein the piezoelectric element holding portion and the reservoir portion are formed by etching the sealing plate forming material by use of an insulation film as the mask pattern, the insulation film being formed by thermally oxidizing the sealing plate forming material.

9. The method according to claim 8, further comprising the step of:

forming interconnections for connecting the piezoelectric elements and a drive IC for driving the piezoelectric elements, on the insulation film, before the step of forming the piezoelectric element holding portion and the reservoir portion.

* * * * *